US005926874A

United States Patent [19]

Browder

[11] Patent Number: 5,926,874

[45] Date of Patent: Jul. 27, 1999

[54] AUTOMATIC BED MAKER

[76] Inventor: Tabor W. Browder, P.O. Box 3454, North Conway, N.H. 03860

[21] Appl. No.: 08/848,039

[22] Filed: Apr. 28, 1997

Related U.S. Application Data

[63] Continuation of application No. 08/490,165, Jun. 14, 1995, abandoned.

[51] Int. Cl.[6] ..... A47C 21/02

[52] U.S. Cl. ..... 5/488; 5/482; 5/502; 5/504.1

[58] Field of Search ..... 5/423, 710, 712, 5/713, 726, 482, 488, 494, 502, 504.1, 505.1, 506.1, 658, 925, 926, 284; 601/148, 149; 62/261

[56] References Cited

U.S. PATENT DOCUMENTS

| | | | |
|---|---|---|---|
| 427,533 | 5/1890 | Arnold | 5/488 |
| 2,093,834 | 9/1937 | Gaugler . | |
| 2,674,751 | 4/1954 | Kilpatrick | 5/506.1 |
| 2,872,690 | 2/1959 | Neisler, Jr. et al. | 5/712 |
| 2,947,008 | 8/1960 | Wild | 5/506.1 |
| 2,998,817 | 9/1961 | Armstrong . | |
| 3,344,444 | 10/1967 | McNeal | 5/488 |
| 3,388,406 | 6/1968 | Scrivner | 5/488 |
| 3,581,321 | 6/1971 | Geary | 5/488 |
| 3,600,728 | 8/1971 | Kinzel | 5/284 |
| 3,639,929 | 2/1972 | Ichise | 5/504.1 |
| 3,678,520 | 7/1972 | Evans . | |
| 3,855,655 | 12/1974 | Propst | 5/923 |
| 3,895,404 | 7/1975 | Wilson | 5/488 |
| 3,946,450 | 3/1976 | Staggs | 5/488 |
| 4,024,591 | 5/1977 | Raczkowski | 5/488 |
| 4,040,133 | 8/1977 | Gilreath | 5/500 |
| 4,042,985 | 8/1977 | Raczkowski | 5/488 |
| 4,305,167 | 12/1981 | Bargados | 5/488 |
| 4,441,222 | 4/1984 | Tascarella | 5/488 |
| 4,489,452 | 12/1984 | Lickert | 5/710 |
| 4,660,388 | 4/1987 | Greene, Jr. | 5/423 |
| 4,662,433 | 5/1987 | Cahn et al. . | |
| 4,697,290 | 10/1987 | Alklind et al. | 5/710 X |
| 4,711,275 | 12/1987 | Ford et al. | 5/710 |
| 4,802,250 | 2/1989 | Farr | 5/488 |
| 4,826,715 | 5/1989 | Lee | 5/712 |
| 4,959,877 | 10/1990 | Covil | 5/505.1 |
| 4,984,316 | 1/1991 | Simpson et al. | 5/423 |
| 4,995,124 | 2/1991 | Wridge, Jr. et al. | 5/713 |
| 5,099,531 | 3/1992 | Schmier | 5/494 |
| 5,142,717 | 9/1992 | Everard et al. | 5/713 |
| 5,146,634 | 9/1992 | Hunt . | |
| 5,182,826 | 2/1993 | Thomas et al. | 5/713 |
| 5,184,612 | 2/1993 | Augustine | 5/482 |
| 5,189,742 | 3/1993 | Schild | 5/713 |
| 5,257,430 | 11/1993 | Yamaguchi | 5/488 |
| 5,267,363 | 12/1993 | Chaffee | 5/713 |
| 5,313,679 | 5/1994 | Yamaguchi . | |
| 5,815,861 | 10/1998 | LaGrange et al. | 5/504.1 |

FOREIGN PATENT DOCUMENTS

| | | | |
|---|---|---|---|
| 360733 | 3/1990 | European Pat. Off. | 5/713 |
| 4220138 | 9/1993 | Germany | 5/713 |

*Primary Examiner*—Michael F. Trettel
*Assistant Examiner*—Robert G. Santos
*Attorney, Agent, or Firm*—Kenyon & Kenyon

[57] ABSTRACT

An automatic bed maker which uses the expansion of inflatable bladder (30) to straighten, align, and tuck-in bed-cover assembly (35). A blanket or insulating layer (29) and top bed sheet (33) are fastened to the bladder (30) forming assembly (35). Assembly (35) is anchored to the bed (38). A blower (55) inflates the bladder (30). A tuck platform (70) drops down to create a tuck opening (73) in the box frame (38B) below the mattress (38A). The tuck protrusion (45A) inflates and enters the tuck opening (73). The tuck opening (73) closes, restraining the left and right side periphery areas of assembly (35). The bladder (30) deflates, leaving the bed covers in their correct, made position.

7 Claims, 37 Drawing Sheets

AUTOMATIC BED MAKER

This application is a continuation of application Ser. No. 08/490,165, filed on Jun. 14, 1995 now abandoned.

BACKGROUND

1. Field of Invention

This invention relates to the making of beds, specifically the arranging of the bed covers in an orderly way over and within a bed.

2. Description of Prior Art

Automatic bed makers have been devised to free people up from the time-consuming, daily task of making beds. Two popular approaches have either been to use rollers to slide the bed covers into their "made" position or to use arms to pull and stretch the bed covers over the bed.

Scrivener, in U.S. Pat. No. 3,388,406 (1968), Staggs, in U.S. Pat. No. 3,946,450 (1976), and Raczkowski, in U.S. Pat. No. 4,042,985 (1977) teach the use of rollers at the head and foot ends of the bed to alternately slide the bed covers on and off of the bed surface. The Scrivener apparatus does automatically place a fresh sheet combination over the bed. However, because the sheet combination is has a pocket design, it is more difficult for the user to get into and out of than the conventional arrangement of a separate upper and lower sheet. Staggs solves that problem with his device but at the cost of having a bulky headboard and footboard. The Raczkowski apparatus is less imposing, but allowance is not made for the bed covers to overlap the sides of the bed. Thus appearance and warmth are compromised.

Geary, in U.S. Pat. No. 3,581,321 (1971), Propst, in U.S. Pat. No. 3,855,655 (1974), Raczkowski, in U.S. Pat. No. 4,024,591 (1977), and Tascarella, in U.S. Pat. No. 4,441,222 (1984) teach bed making using U-shaped and L-shaped arms to stretch out the bed covers over the bed. Bargodis, in U.S. Pat. No. 4,305,167 (1981) teaches the use of carrier arms on either of the bed to pull the head-end corners of the covers to the head end of bed. The Geary, Propst, and Raczkowski, 591 devices must be operated during the bed-making process. To operate the Bargodis device, the corners of the bed coverings must be attached manually at the beginning of each bed-making session. All five devices enable one to make beds with varying degrees of efficiency. However, they compromise appearance and safety because all require large, solid, external, moving parts to accomplish their task.

A third approach has been taught by Wilson, U.S. Pat. No. 3,895,404 (1975). The Wilson device has a straightening mechanism of elongated tubes which are placed between the bed covers. However, even at a high inflation pressure, the outward force of the inflating gas against a folded portion of the elongated tube is small. Therefore, like a garden hose, the elongated tube may be held in a crimped position with relatively light pressure from without. When weighted down by bed covers the elongated tubes are inefficient at unfolding themselves and the covers. In an attempt to alleviate this problem vent holes were designed into the elongated tubes. Their purpose was to create a gas pocket by injecting gas between the bed cover layers. However, they are ineffective because the injected gas may escape through the porosities of the bed cover's fabric and from around the edges of the bed covers. Also, the vent holes lower the gas pressure needed in the tubes.

In sum, all previous bed making devices or systems are not very effective, are difficult to operate, compromise comfort, have a high profile, require manual operation, and/or are not appropriate for a bedroom setting.

OBJECTS AND ADVANTAGES

Accordingly, several objects and advantages of my invention are:

(a) To provide an automatic bed maker which completely makes a bed; that is, the straightening, positioning, and tucking-in of the bed covers;

(b) To allow the operator to make a bed by just pushing a button;

(c) To provide bed covers which are able to extend freely over the sides of the bed as in conventional arrangements;

(d) To provide bed covers which allow the user to enter and exit the bed with ease;

(e) To provide an automatic bed maker which fits in aesthetically with the bedroom setting;

(f) To provide for the making of a bed without the need for manual intervention by the operator;

(g) To provide for greater safety in the bed making process because of the absence of large, solid, protruding, moving parts;

(h) To allow the operator to do other work while the automatic bed maker is making the bed.

Additional objects and advantages will become apparent from a consideration of the drawings and ensuing description.

BRIEF DESCRIPTION OF THE DRAWINGS

Basic Version

Preferred Embodiment

Figure 5:
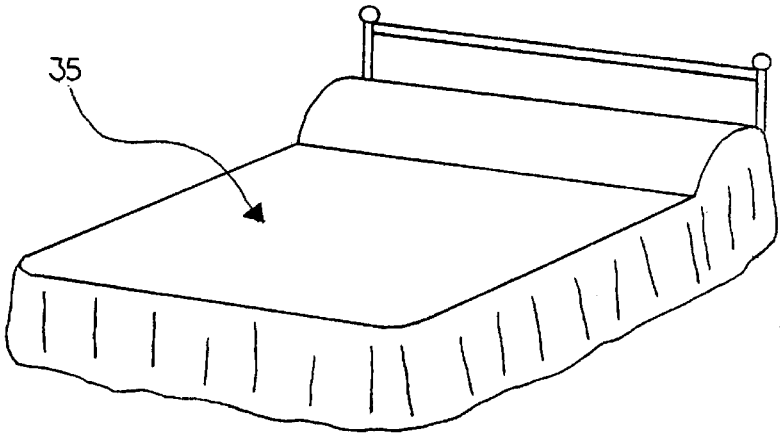

FIG. 5 is a perspective view of the preferred embodiment of a bed-making device according to the invention, where the bed is made up and ready for use.

Figure 6:
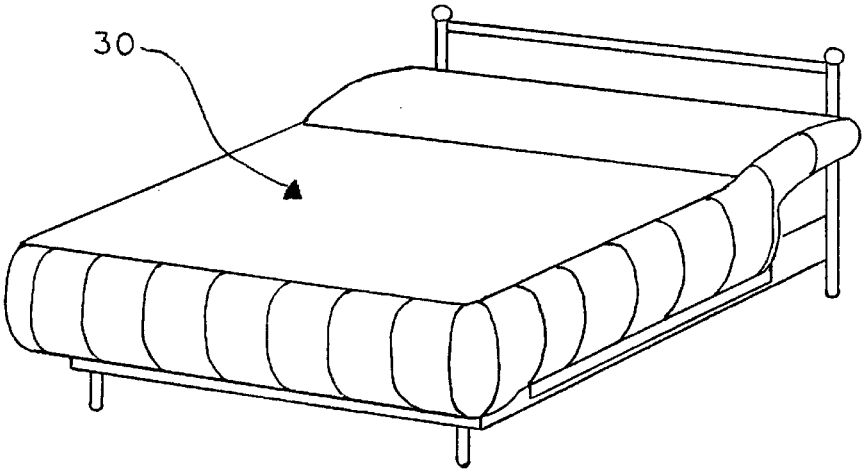

FIG. 6 is a perspective view of the preferred embodiment where the bladder is fully inflated.

Figure 6A:
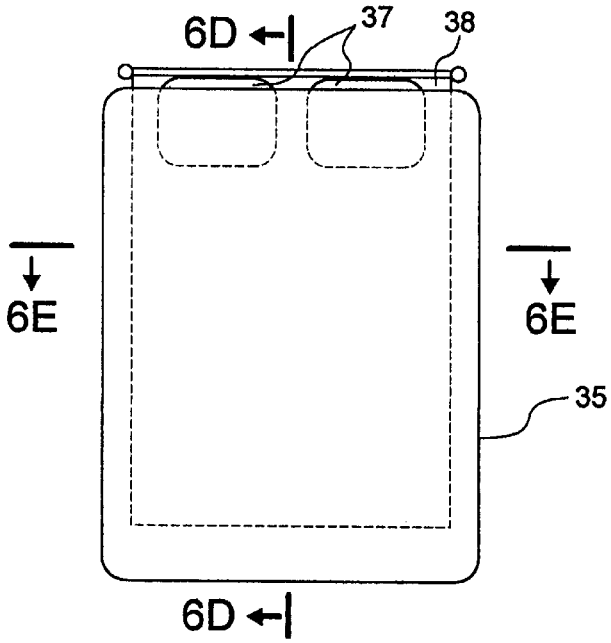

FIG. 6A is an overhead view of the preferred embodiment.

Figure 6B:
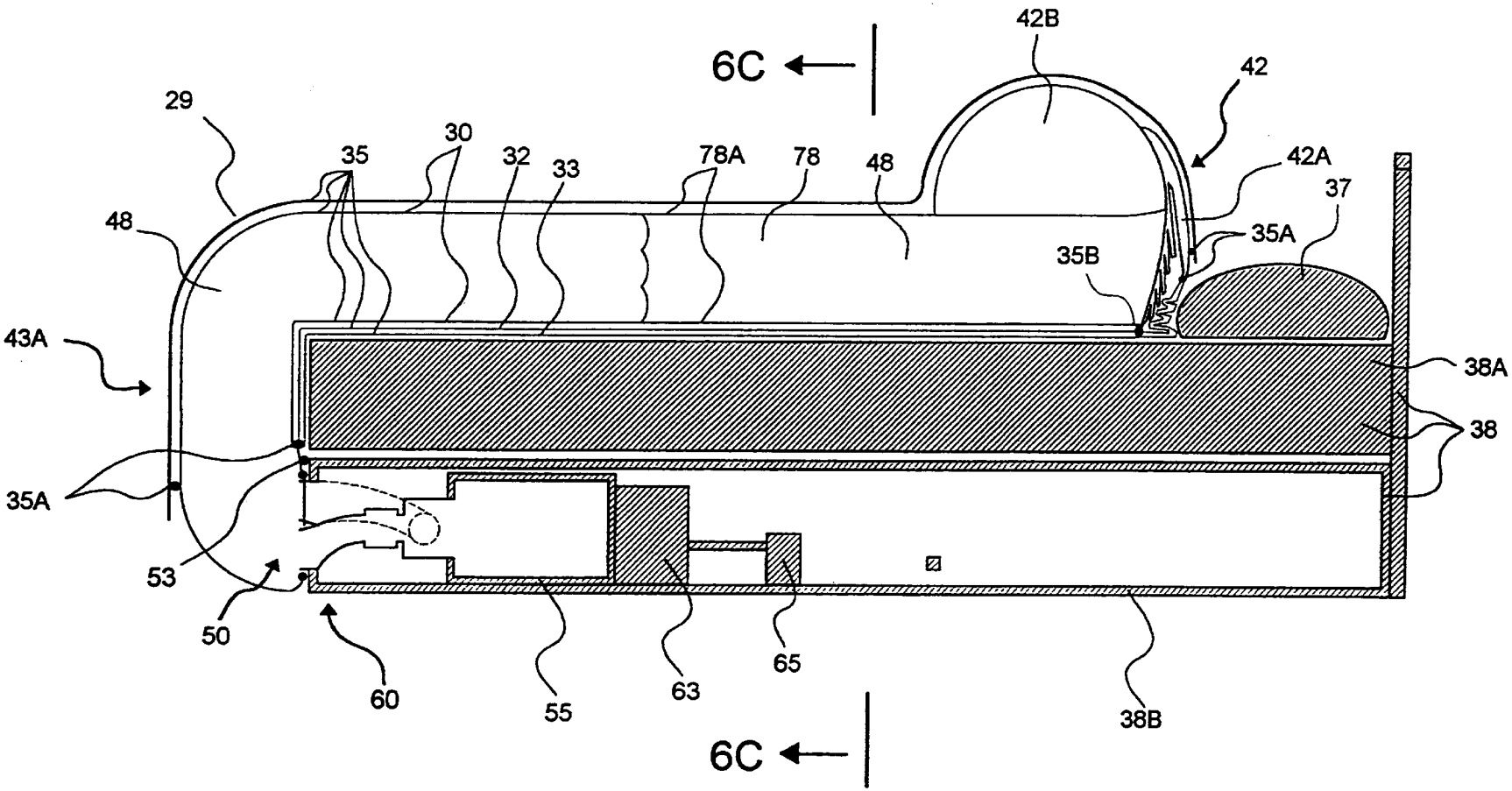

FIG. 6B is a sectional view where a pillow canopy is deflated.

Figure 6C:
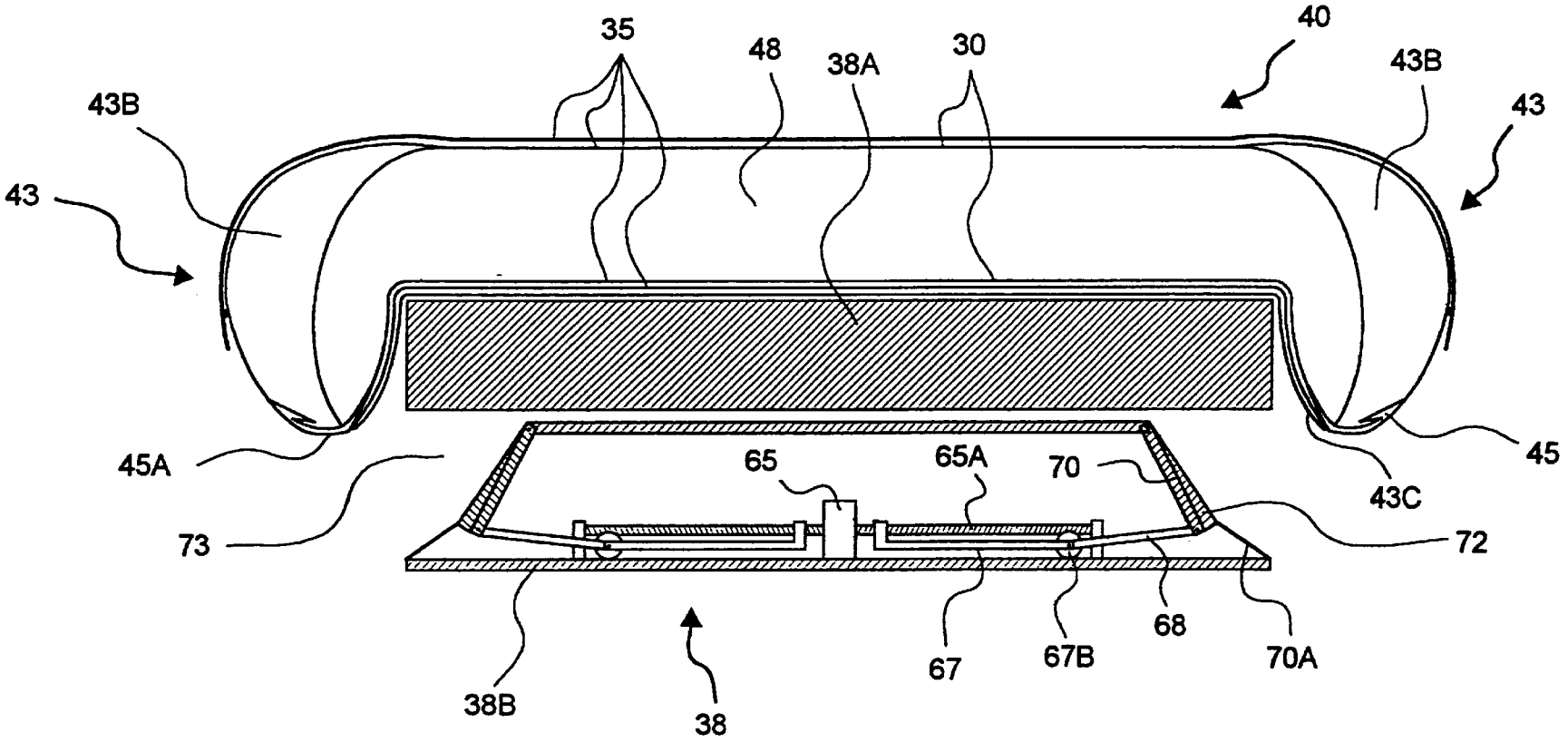

FIG. 6C is a sectional view where a pair of side retraction chambers are inflated.

Figure 6D:
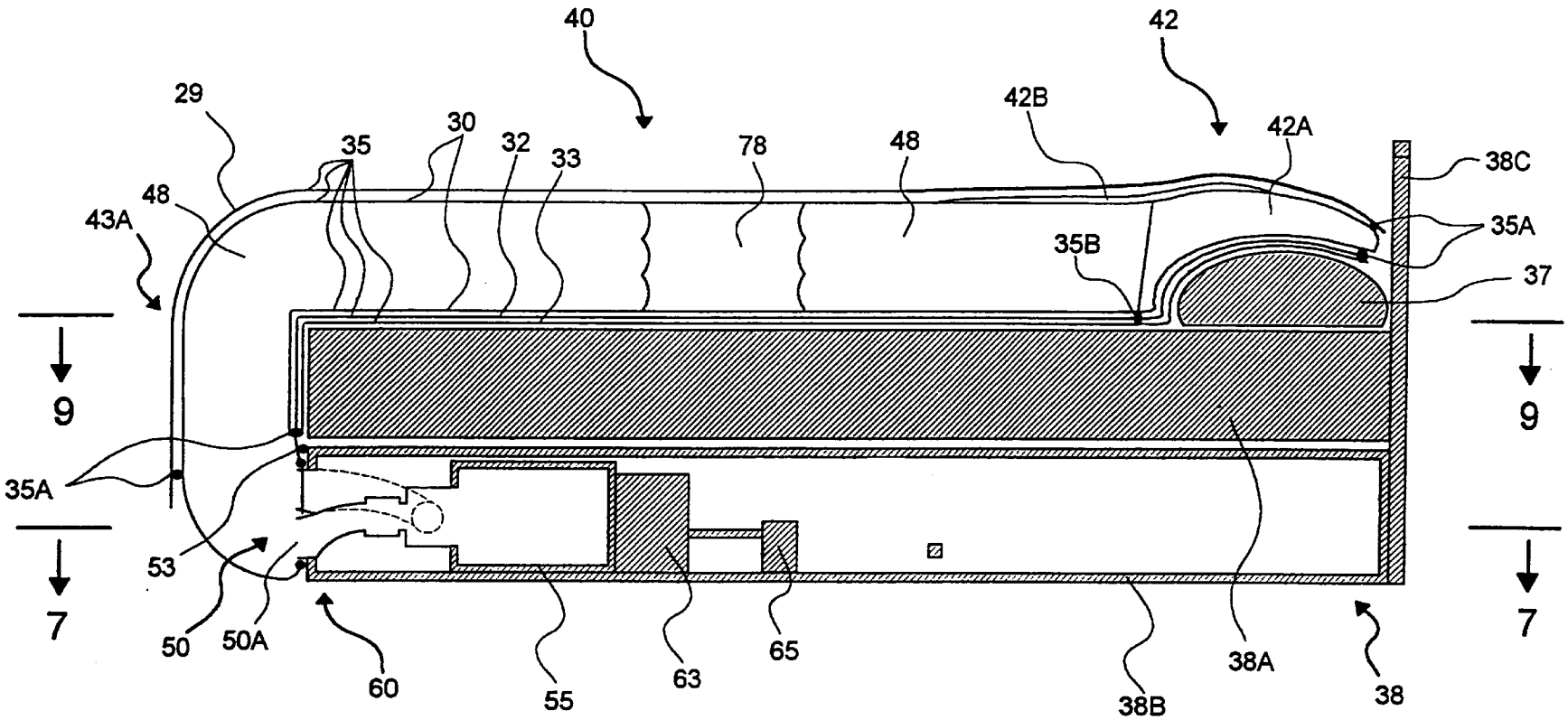

FIG. 6D is a sectional view where the pillow canopy is inflated.

Figure 6F:
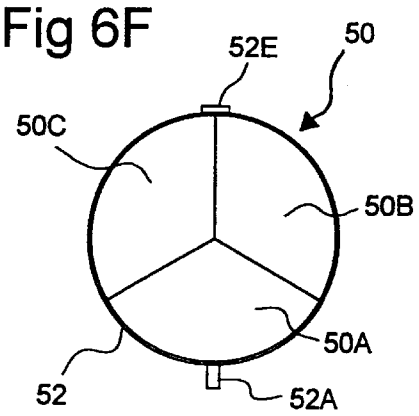
Figure 6G:
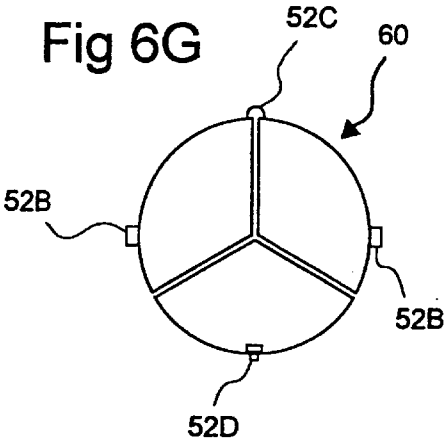
Figure 6E:
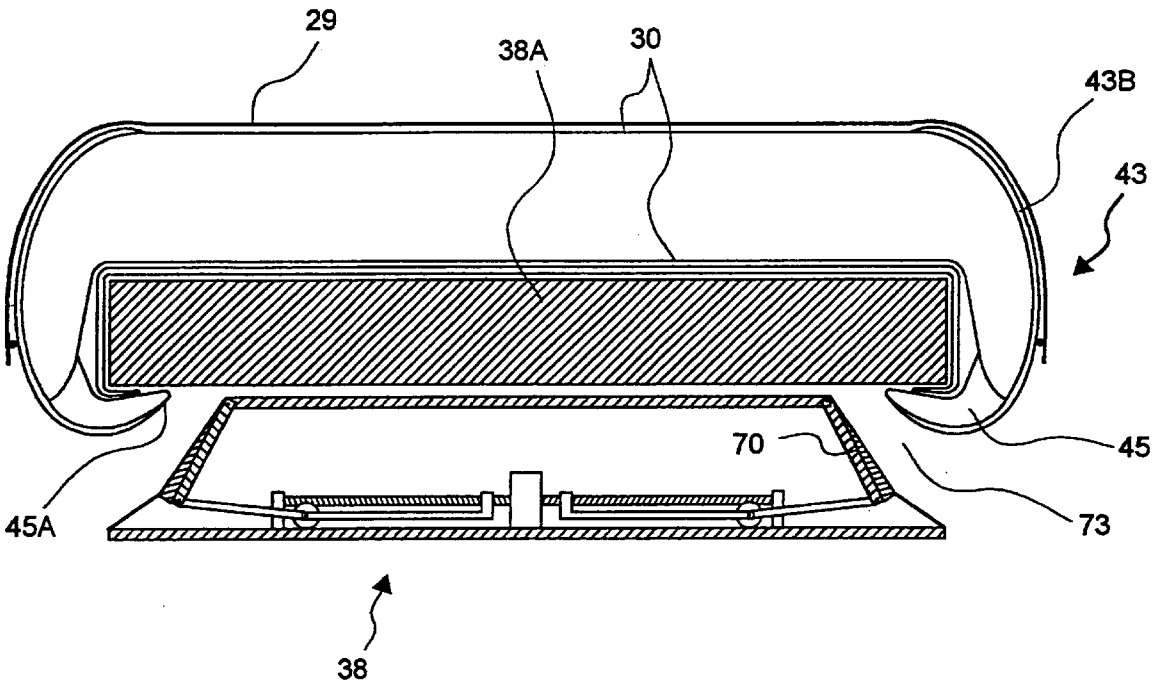

FIG. 6E is a sectional view where a pair of tuck chambers are inflated.

FIG. 6F is a frontal view of a bladder port.

FIG. 6G is a frontal view of a box frame port.

Figure 7:
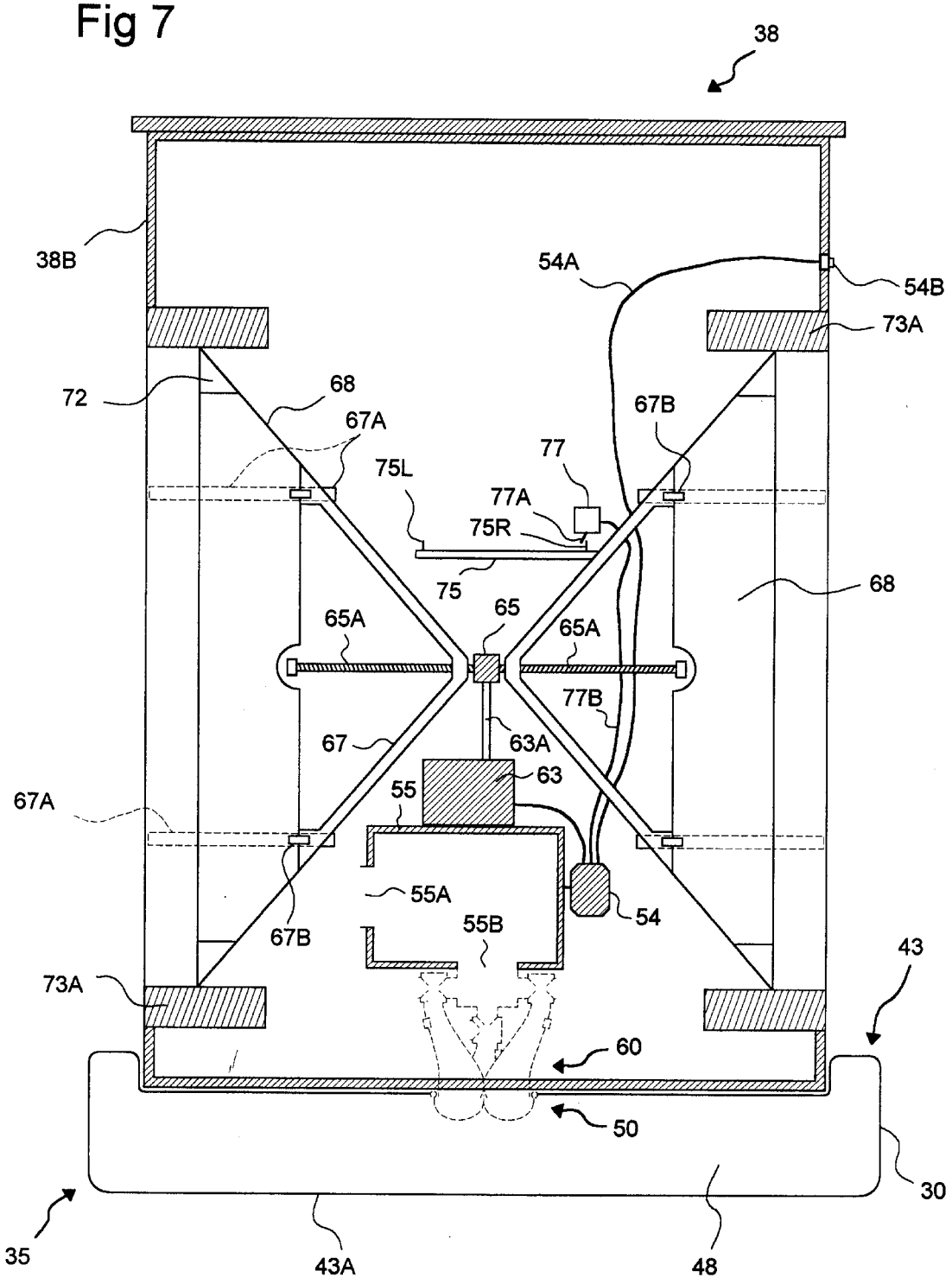

FIG. 7 is a sectional view of a box frame from FIG. 6D.

Figure 7A:
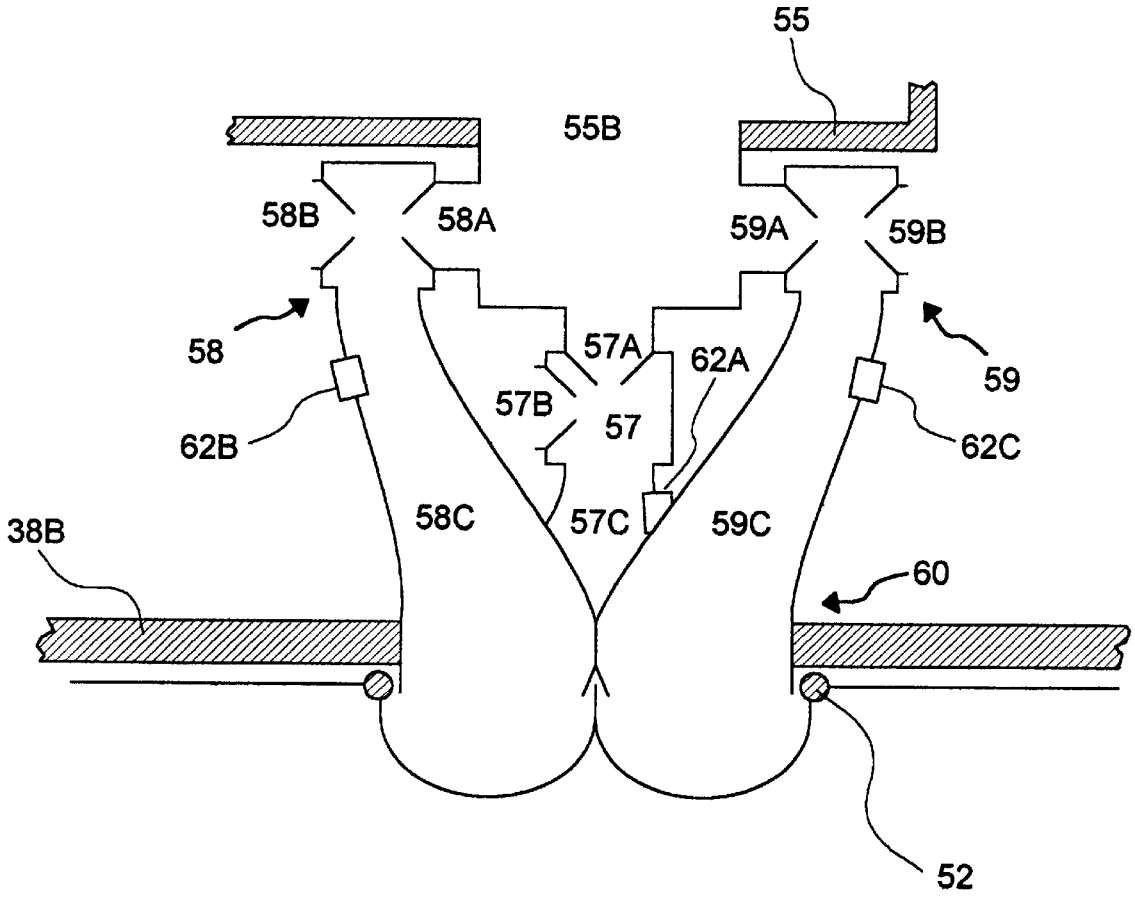

FIG. 7A is an enlarged view of an arrangement of air-pressure modulating valves from FIG. 7.

Figure 8A:
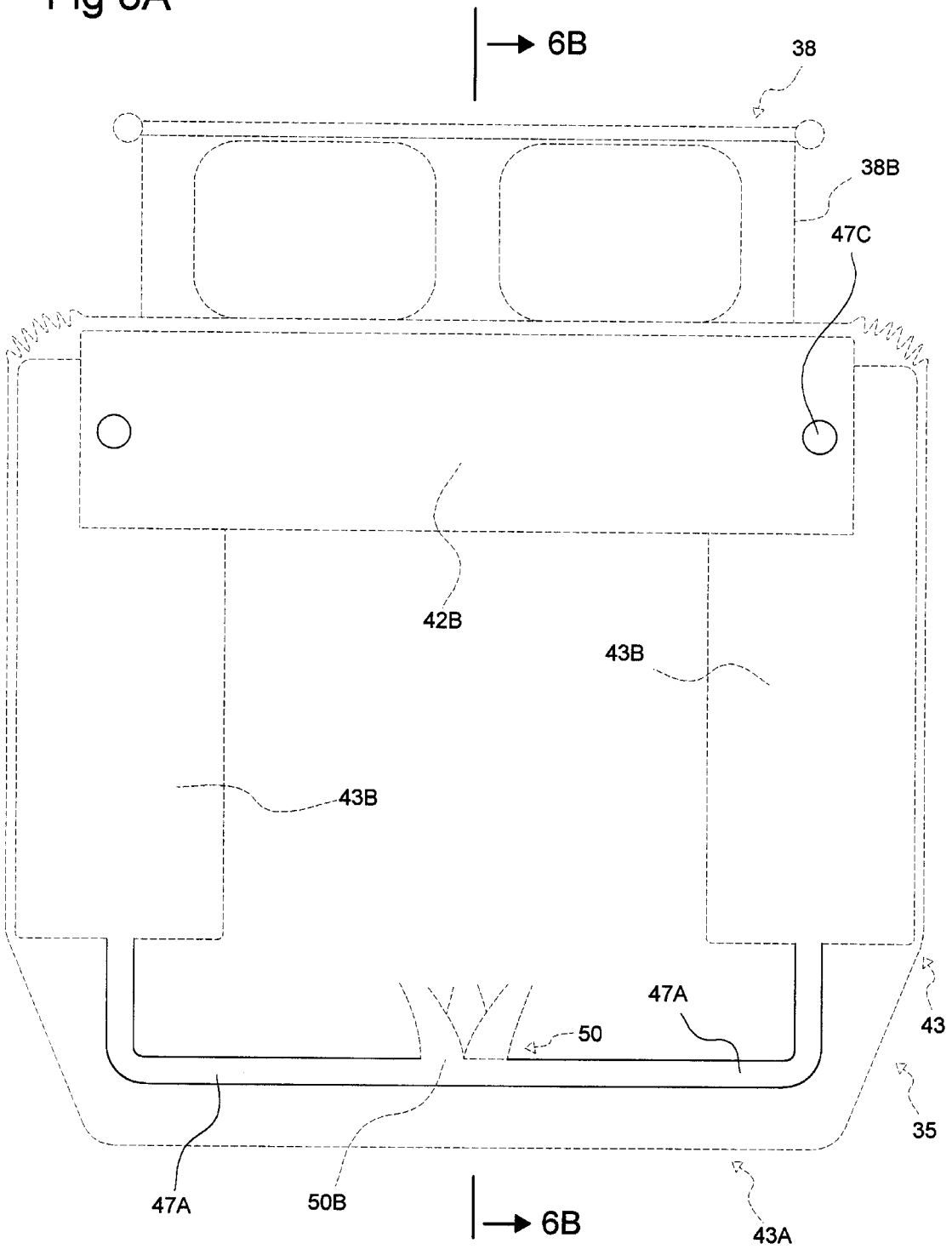

FIG. 8A is an overhead view showing inflation routes for inflating a set of three retraction chambers.

Figure 8B:
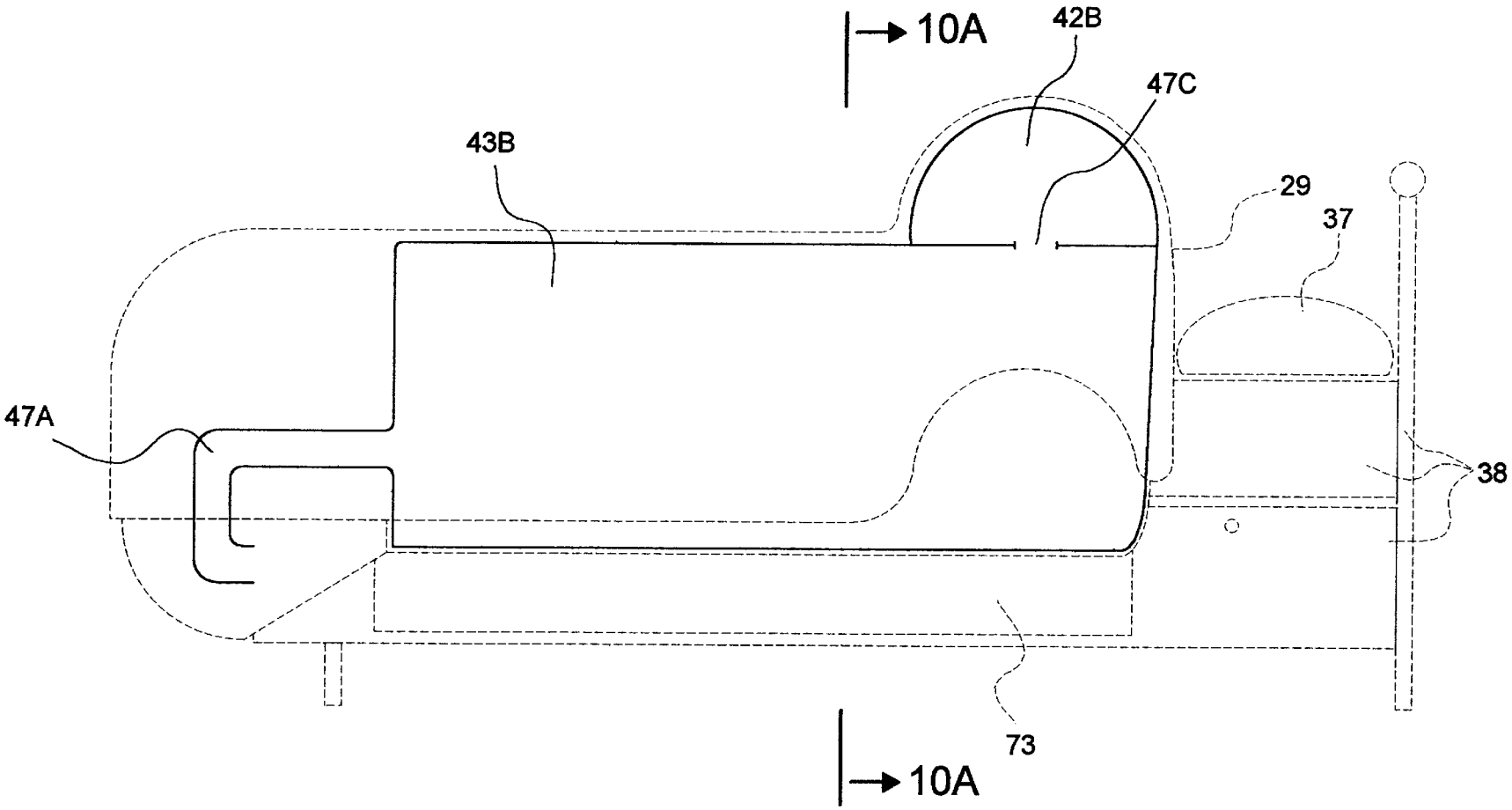

FIG. 8B is a side view showing inflation routes for inflating the retraction chambers.

Figure 8C:
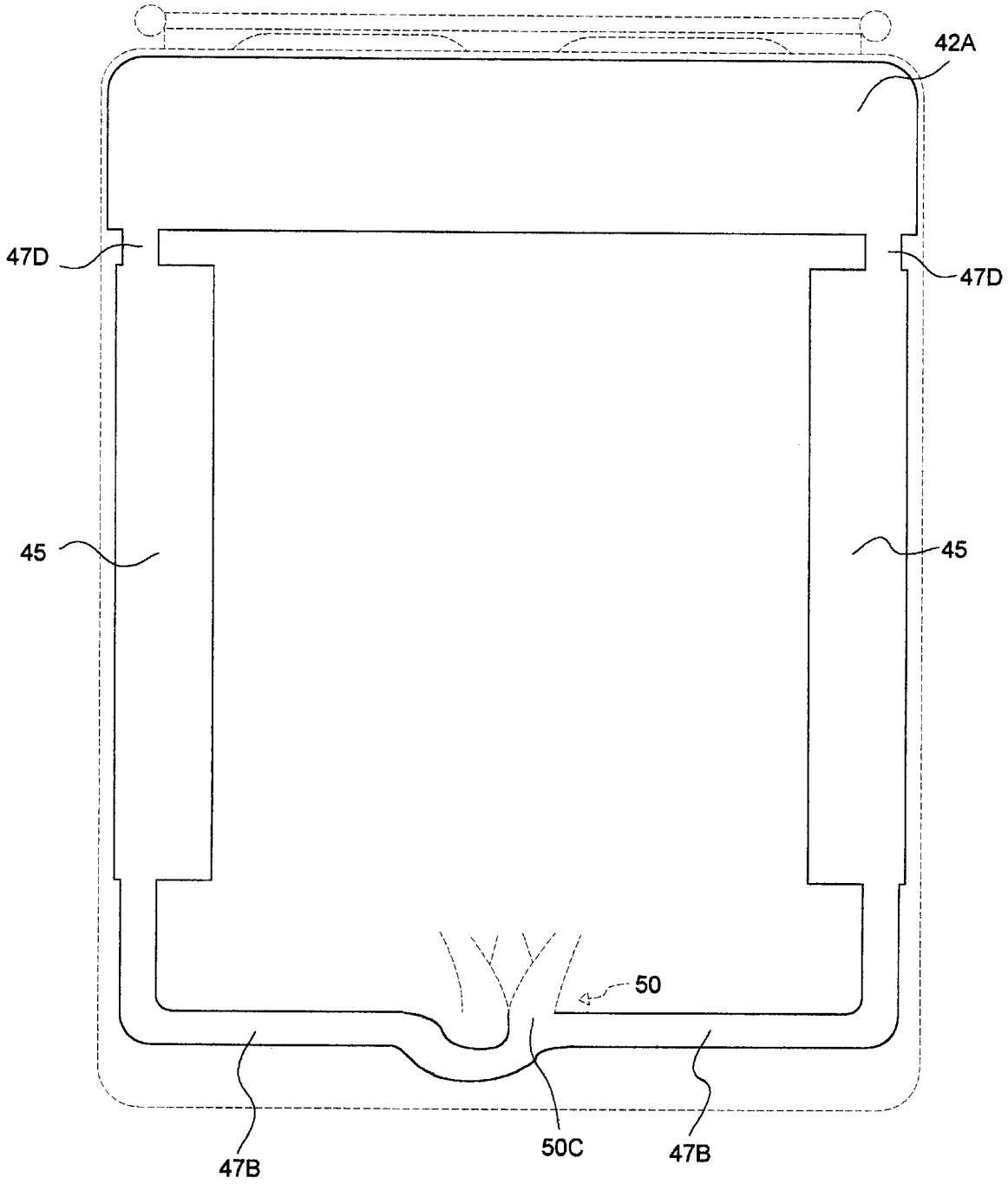

FIG. 8C is an overhead view showing inflation routes for inflating a set of three projection chambers.

Figure 8D:
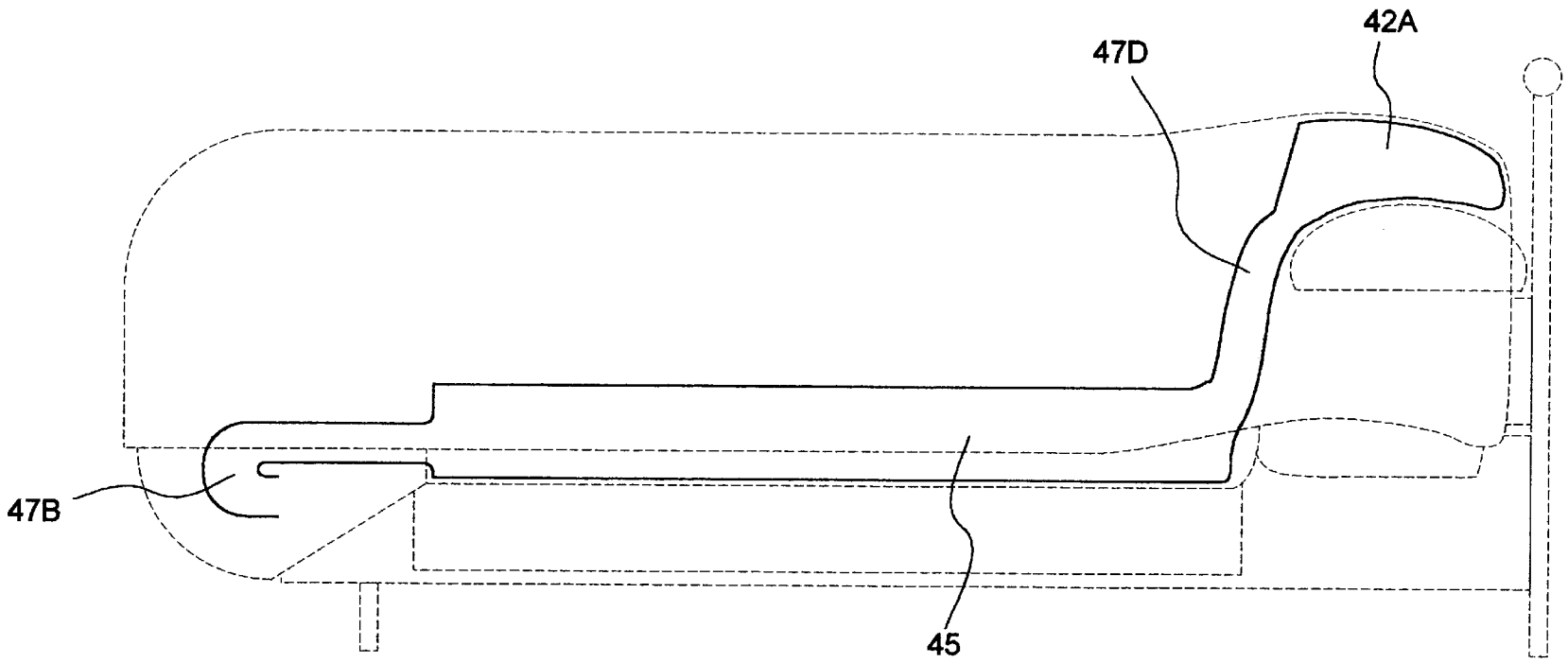

FIG. 8D is a side view showing inflation routes for inflating the projection chambers.

Figure 9:
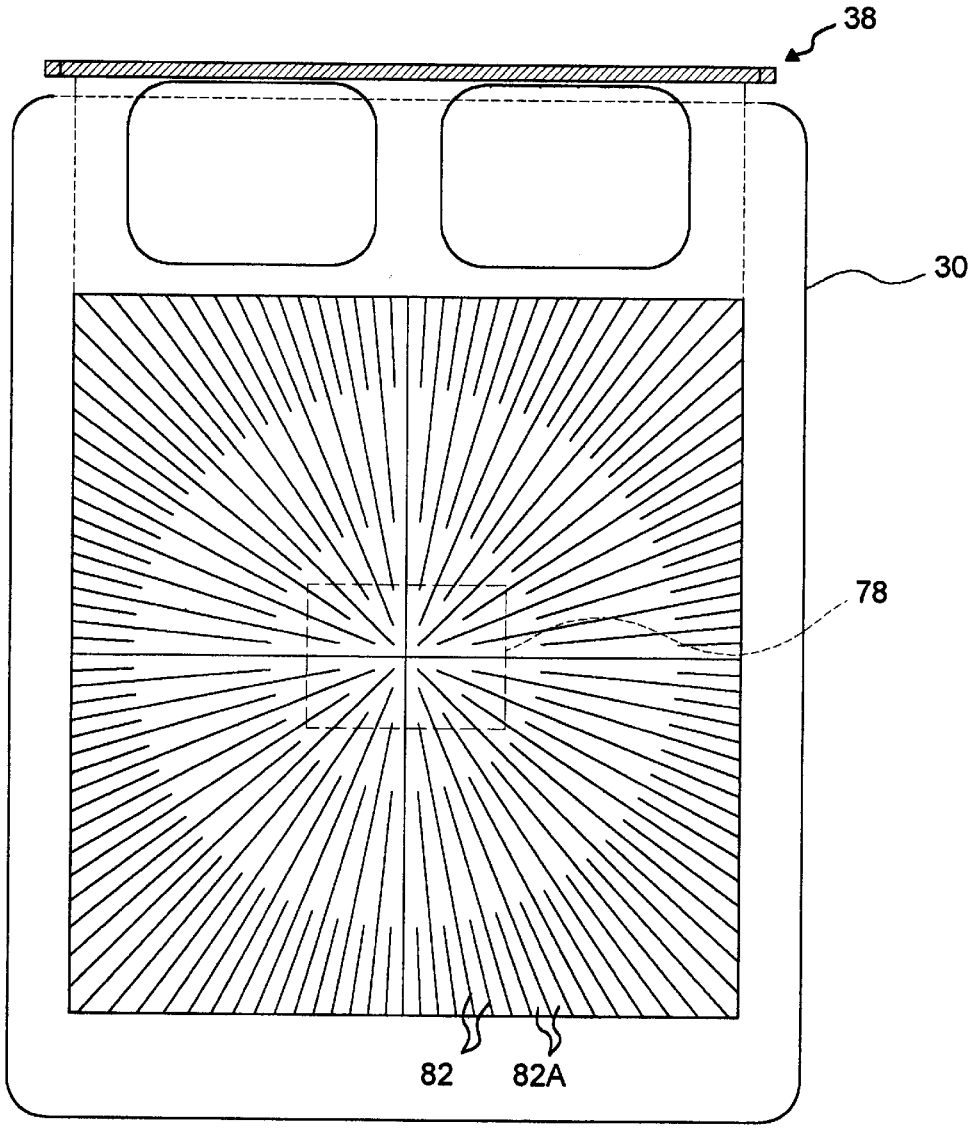

FIG. 9 is a sectional view from FIG. 6D showing an arrangement of air channels and a ventilating opening.

Figure 9A:
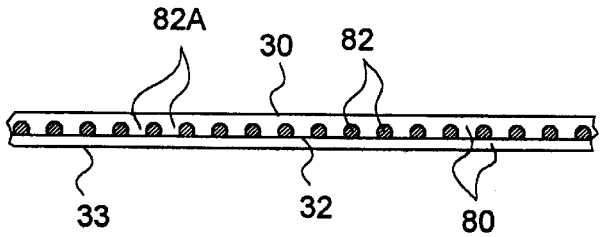

FIG. 9A is a sectional view showing a segment of a sheet, a spacer layer, and lower membrane of the bladder.

Figure 10:
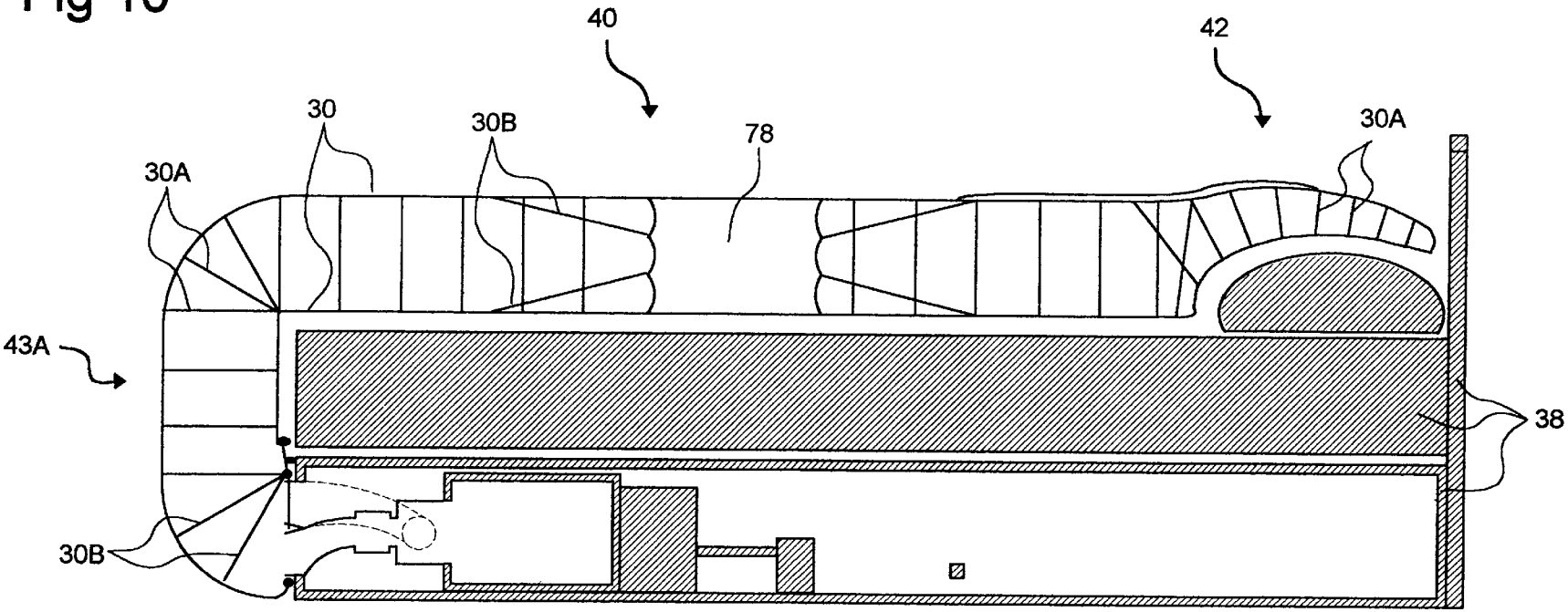

FIG. 10 is a sectional view showing an arrangement of inflation and deflation stringers.

Figure 10A:
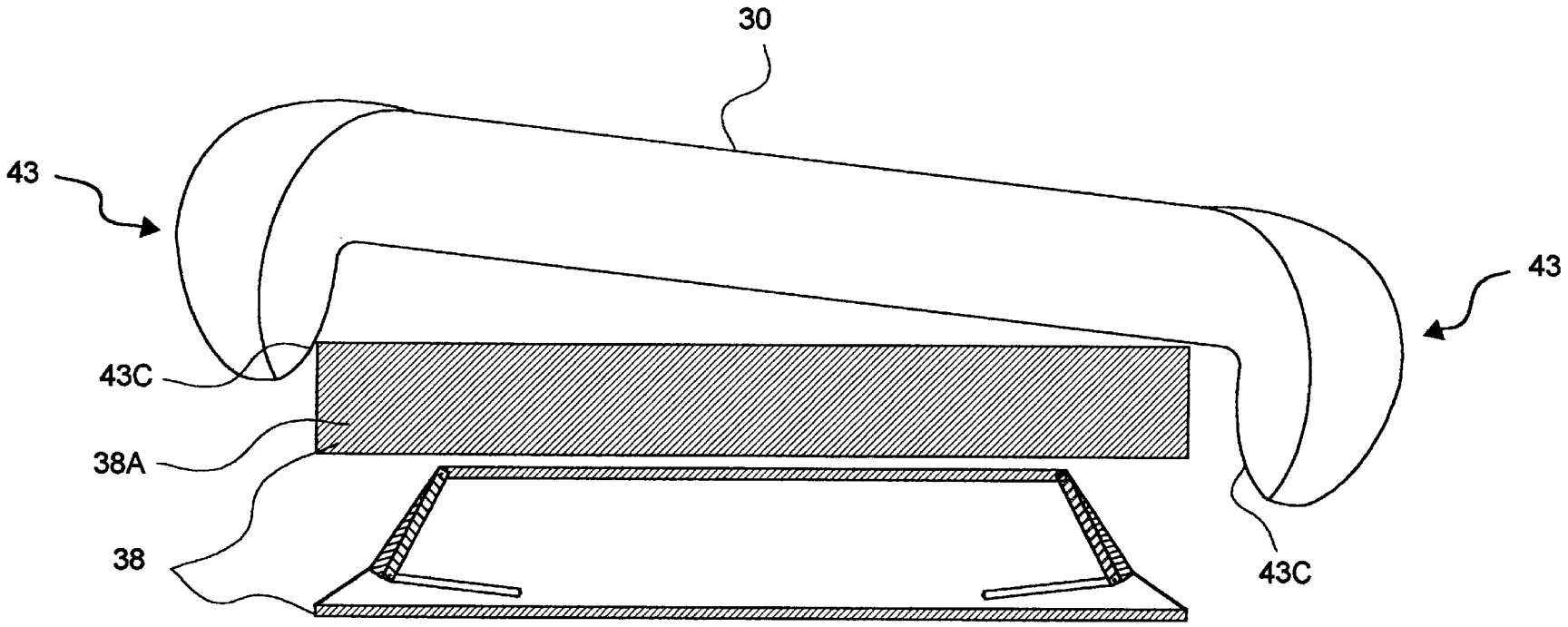

FIG. 10A is a sectional view showing the bladder out of alignment and offset to the right of the bed.

Embodiment with Lift Actuators

Figure 11:
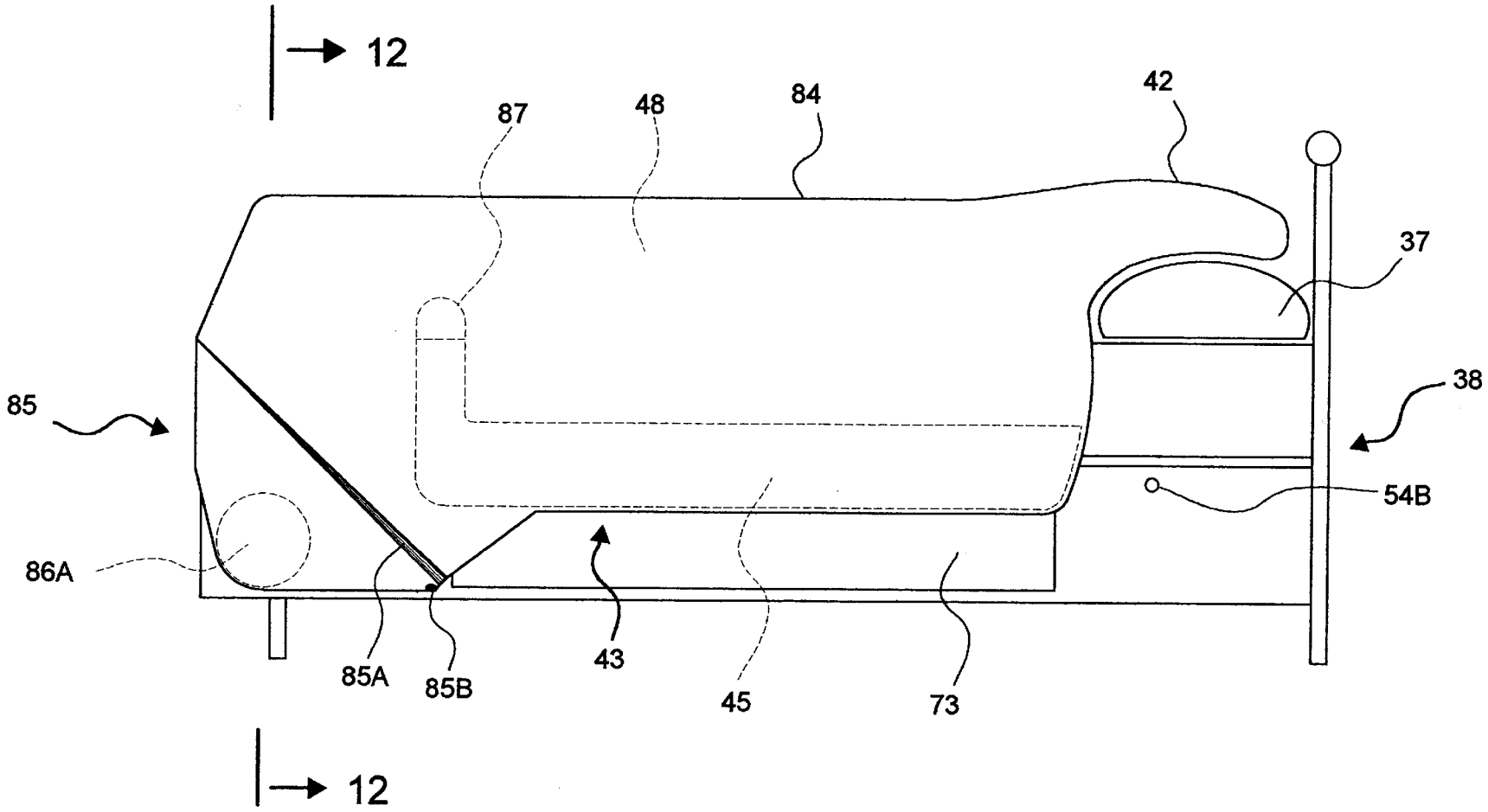

FIG. 11 is a right side view of a bed-making device according to the invention with a primary chamber inflated.

Figure 12:
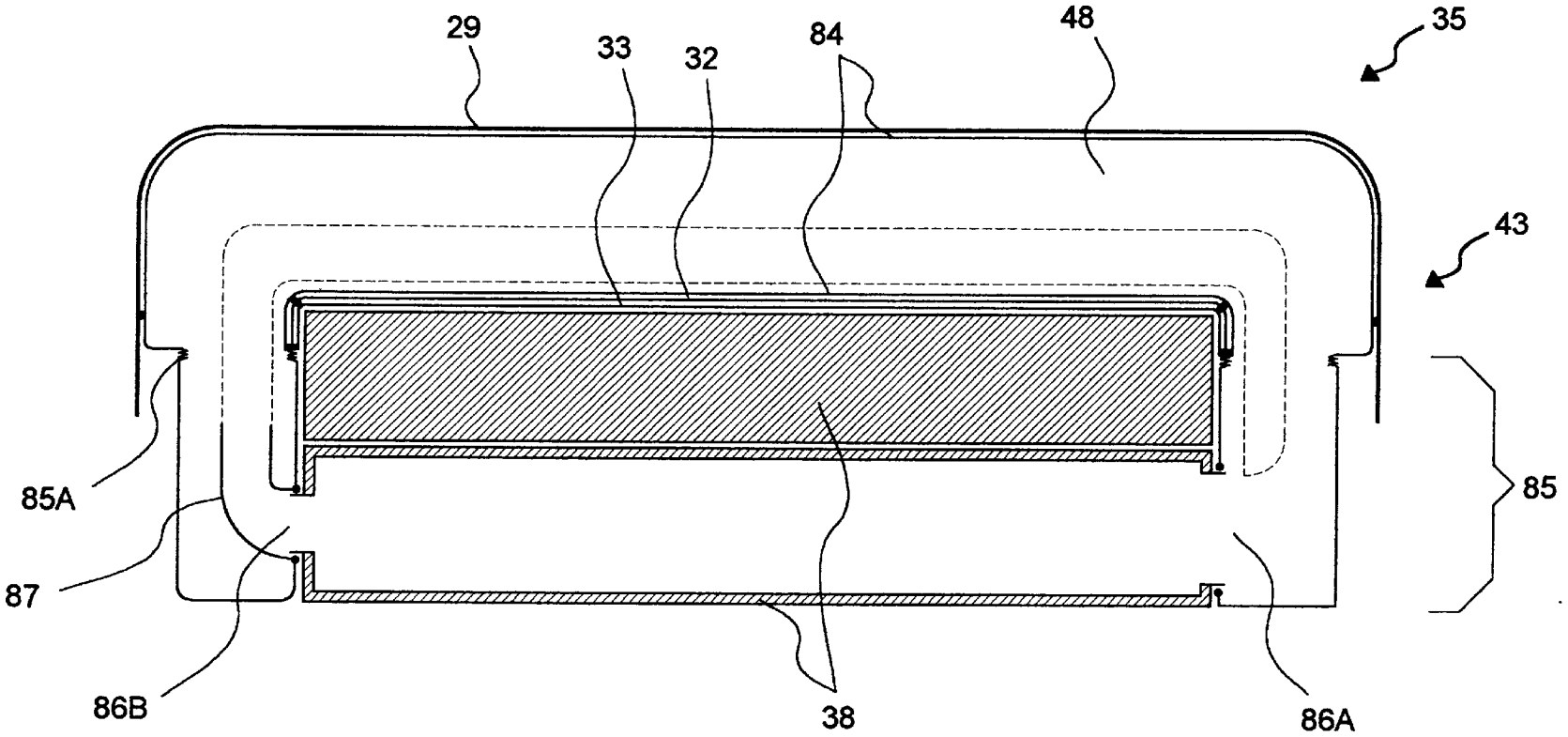

FIG. 12 is a sectional view of the foot end of the bed.

Figure 13:
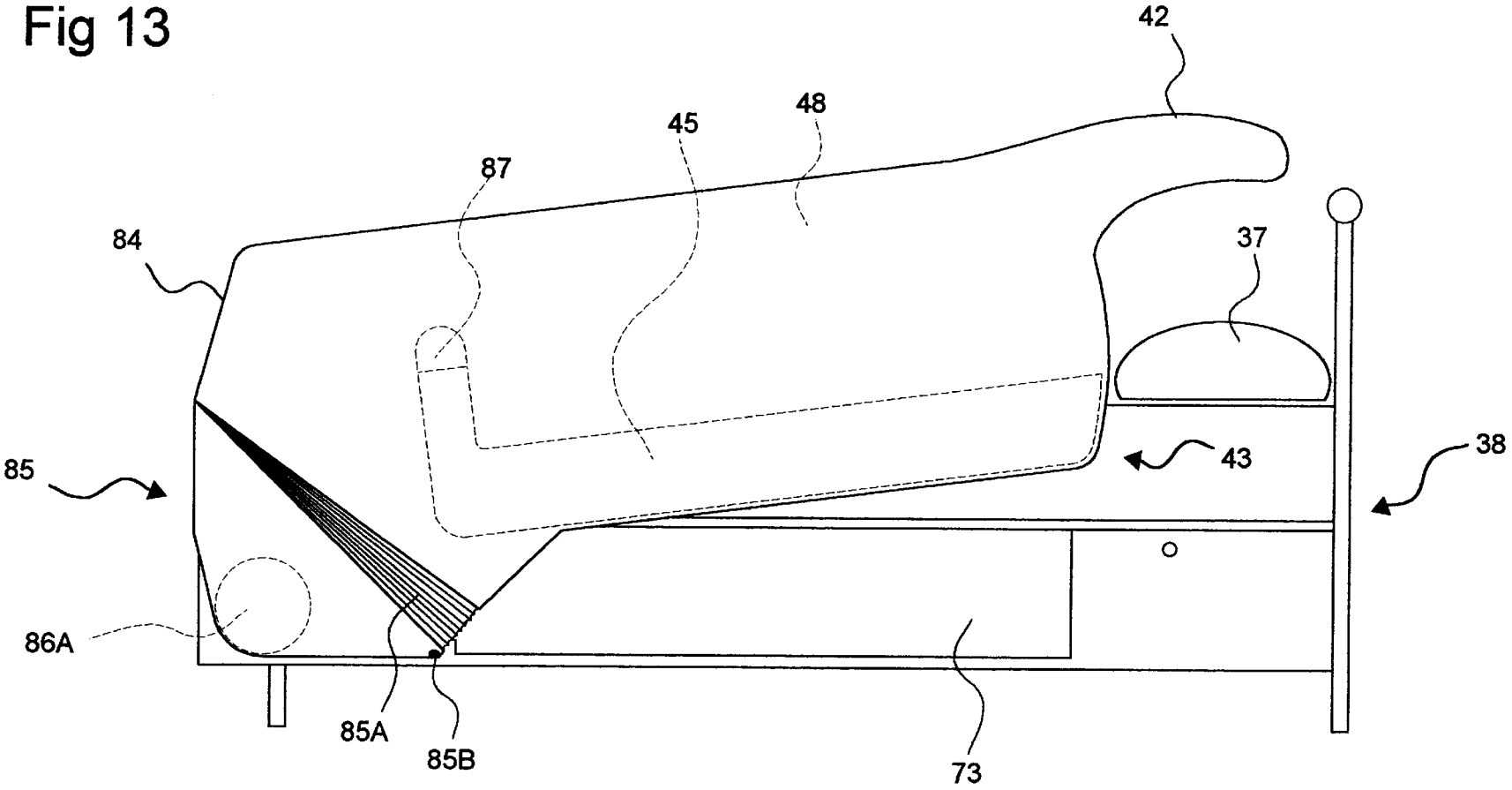

FIG. 13 is a right side view showing an expansion mechanism and the primary chamber fully inflated.

Embodiment with Valved Chamber Walls

Figure 14:
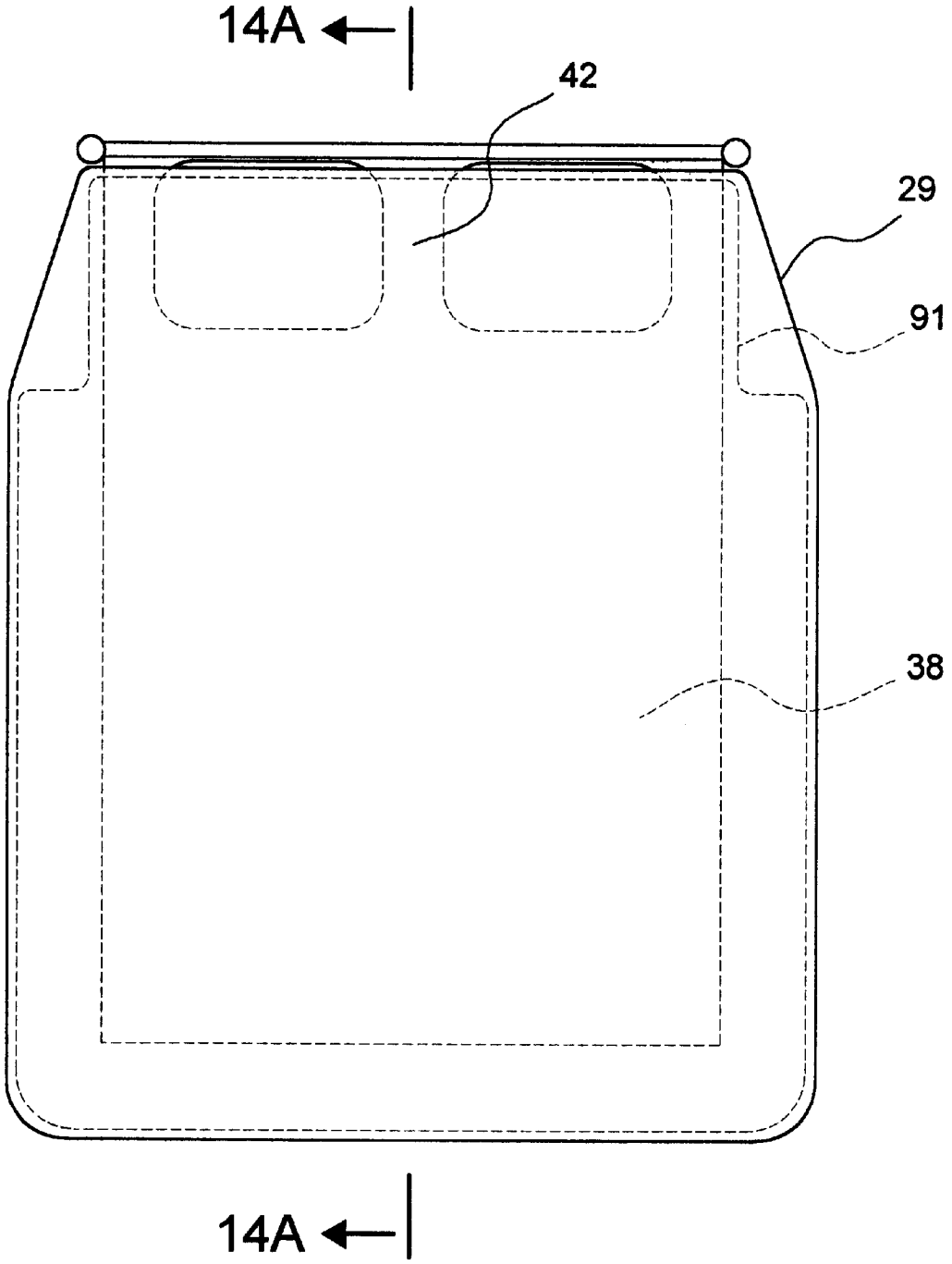

FIG. 14 is an overhead view of a bed-making device according to the invention.

Figure 14A:
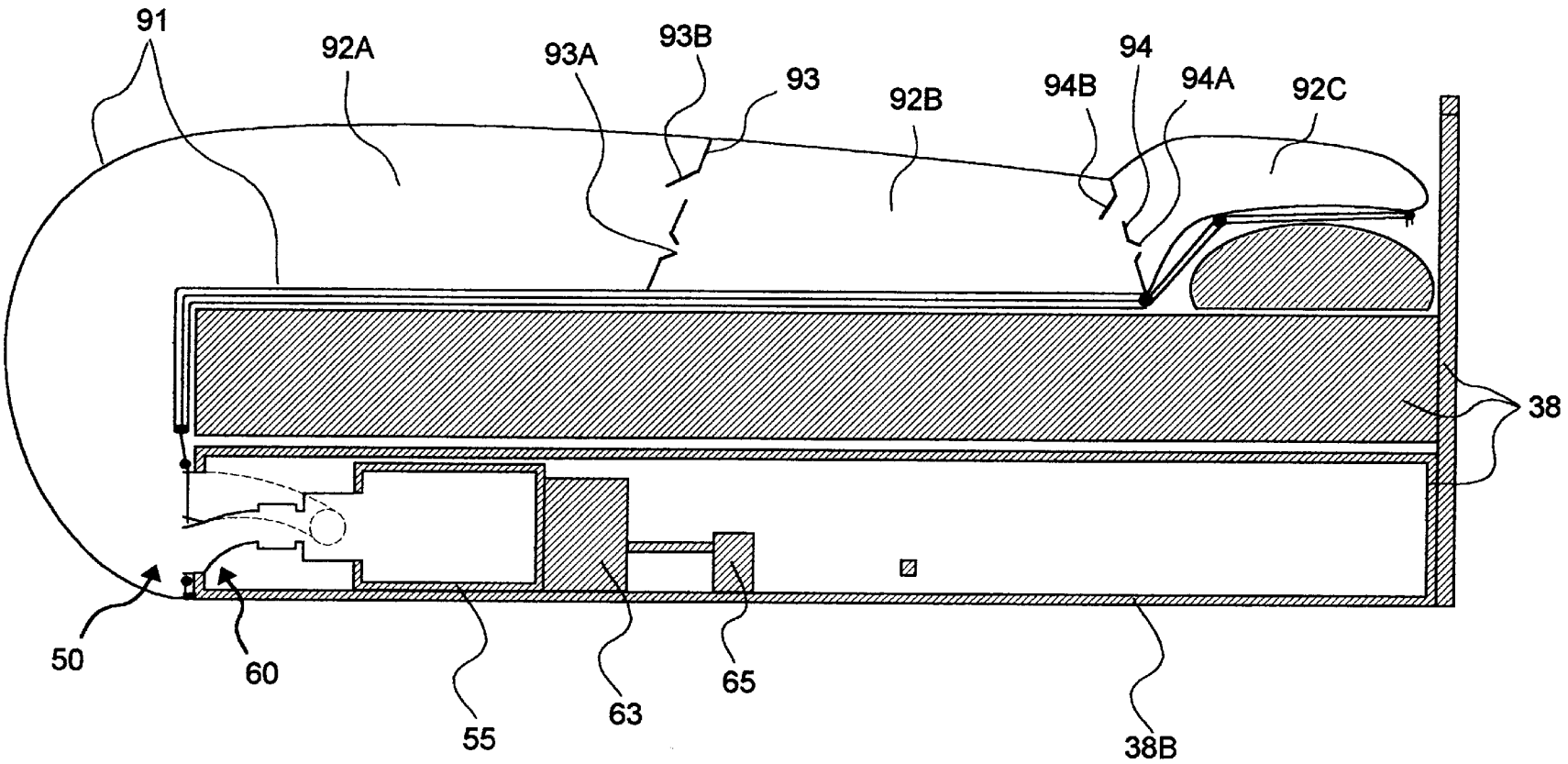

FIG. 14A is a sectional view showing a set of air-pressure modulating valves in a pair of chamber walls.

Figure 14B:
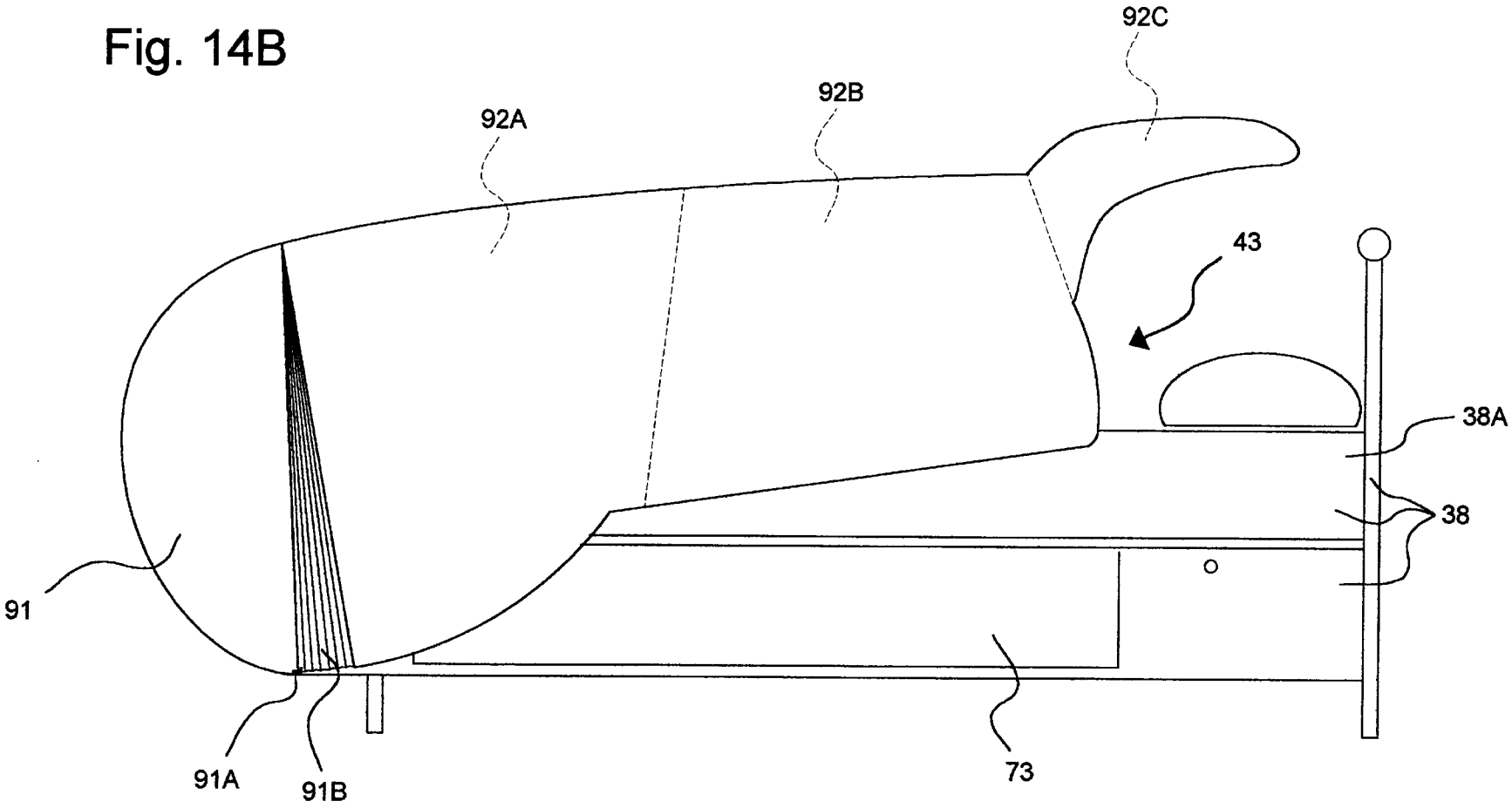

FIG. 14B is a right side view of this embodiment.

Figure 14C:
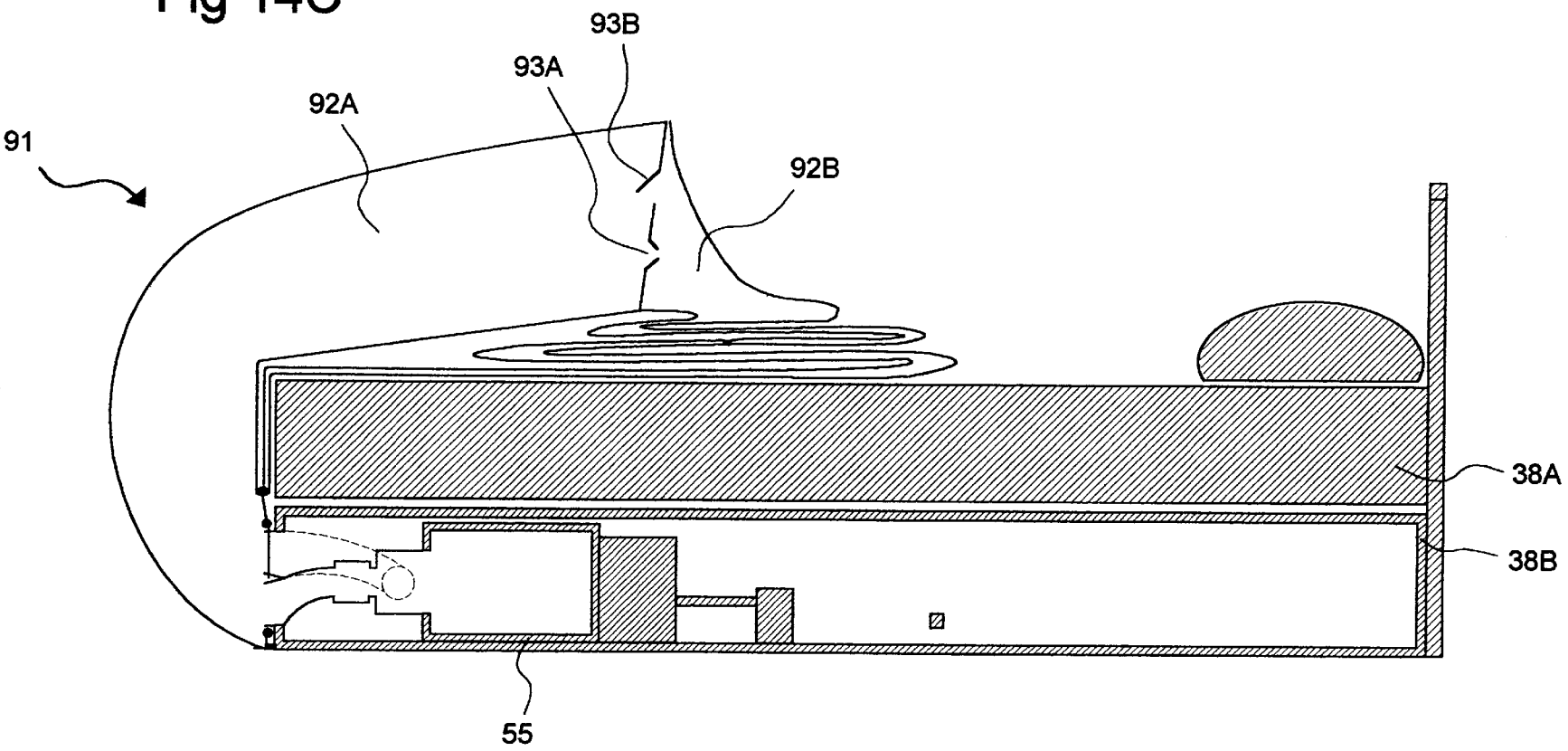

FIG. 14C is a sectional view of first stage of inflating.

Figure 14D:
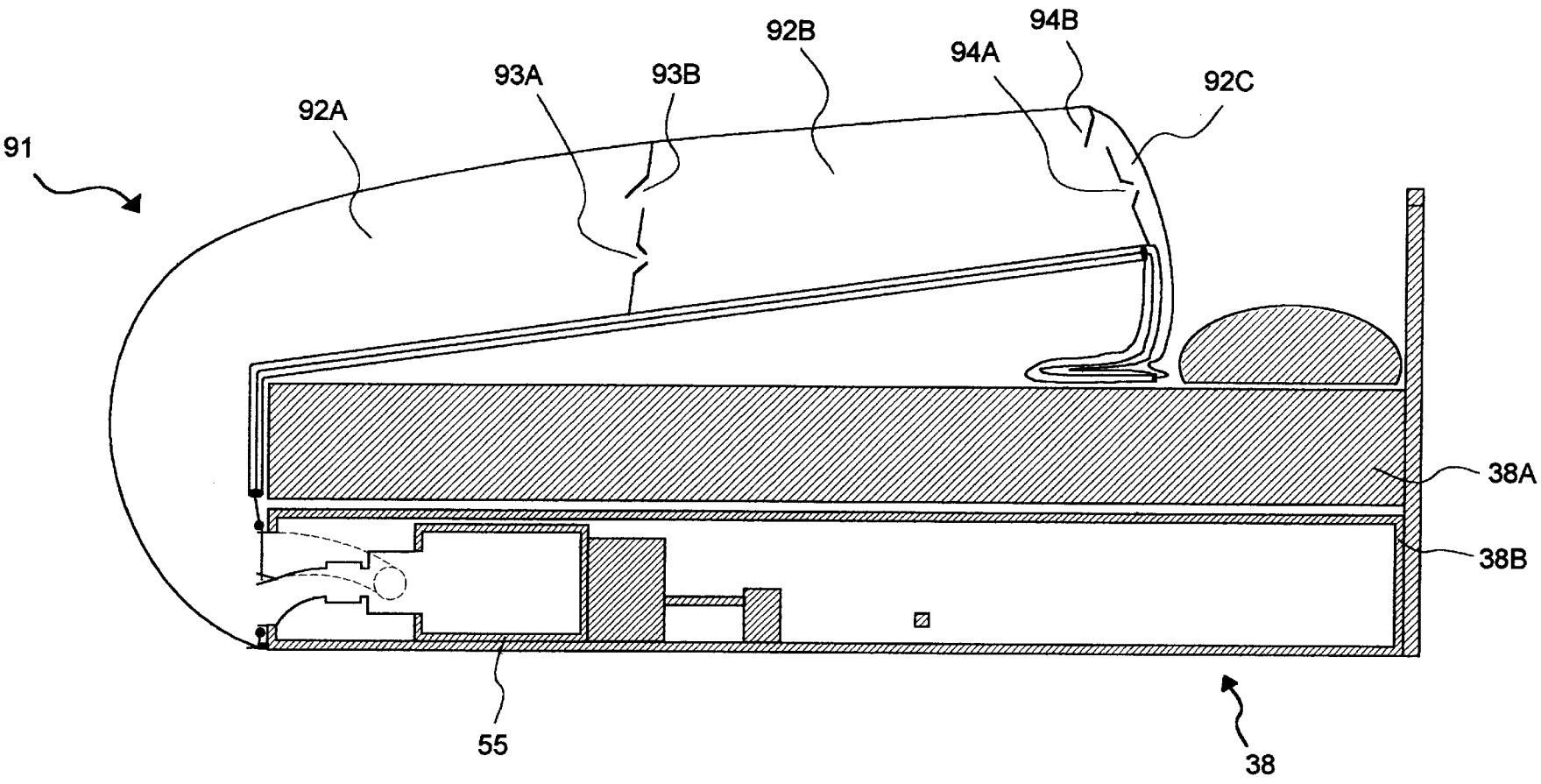

FIG. 14D is a sectional view of second stage of inflating.

Figure 14E:
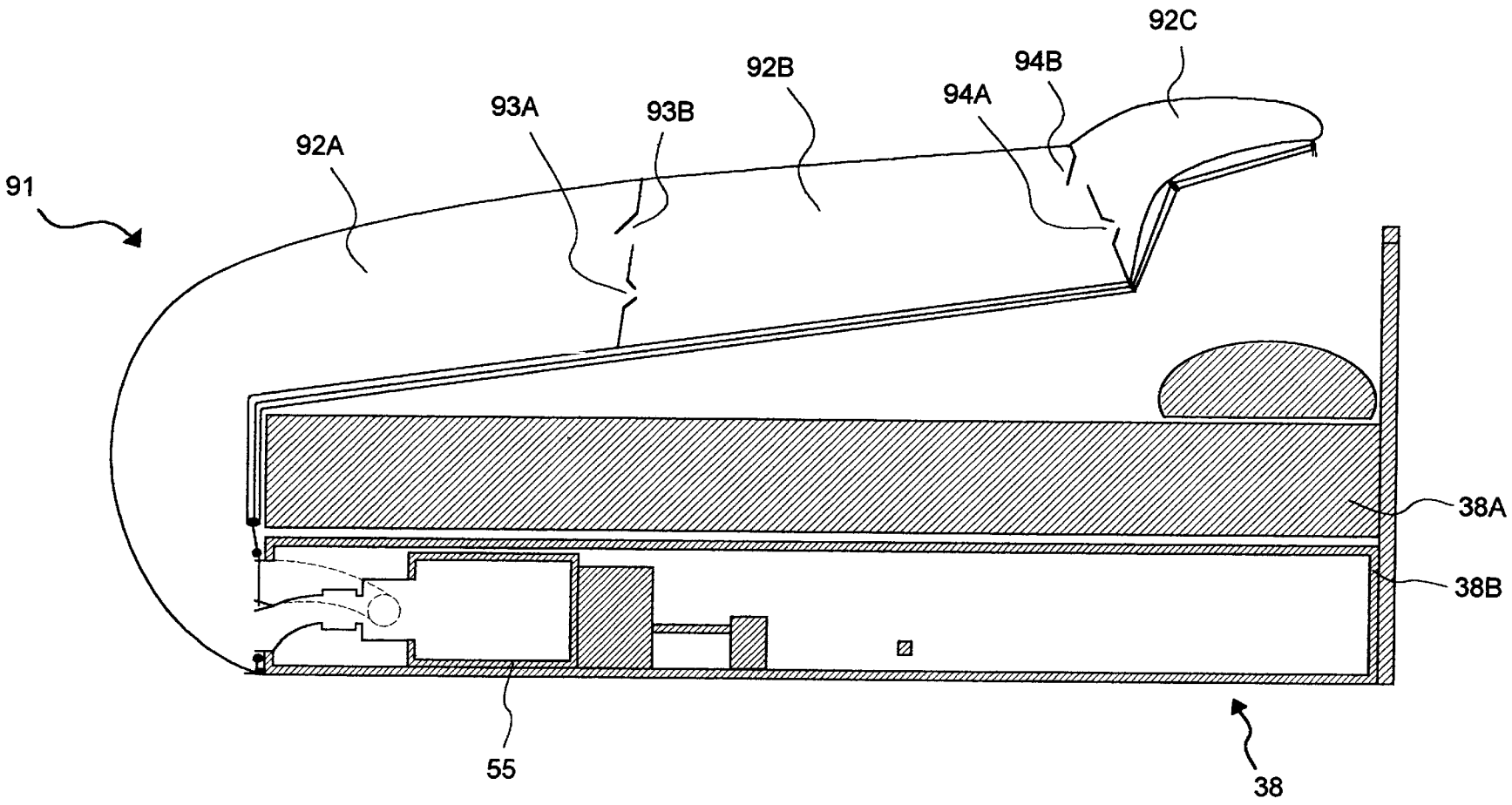

FIG. 14E is a sectional view of third stage of inflating.

Embodiment with Retraction Drawstrings

Figure 15:
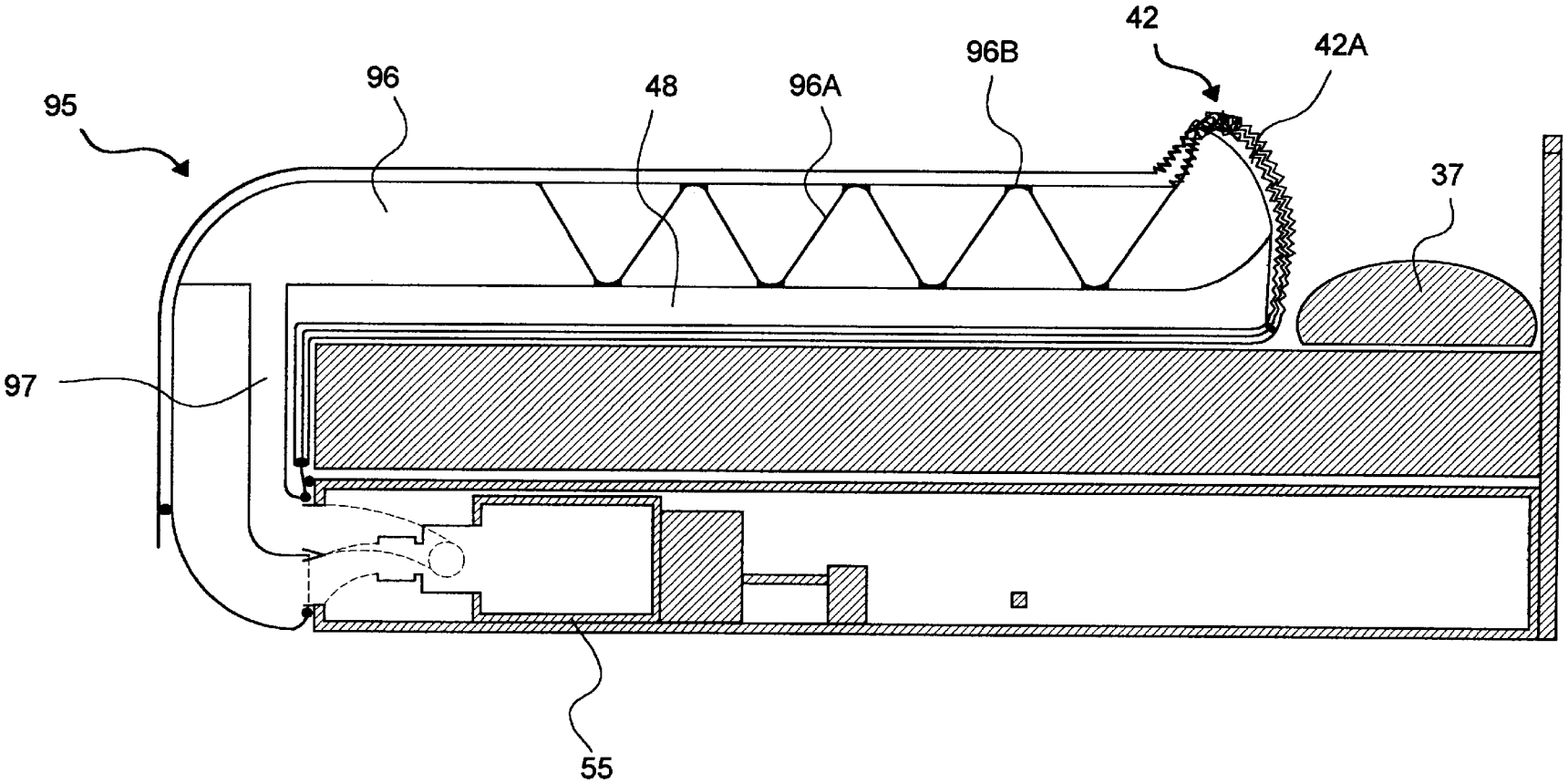

FIG. 15 is a sectional view of a bed-making device according to the invention, with the pillow canopy deflated.

Figure 15A:
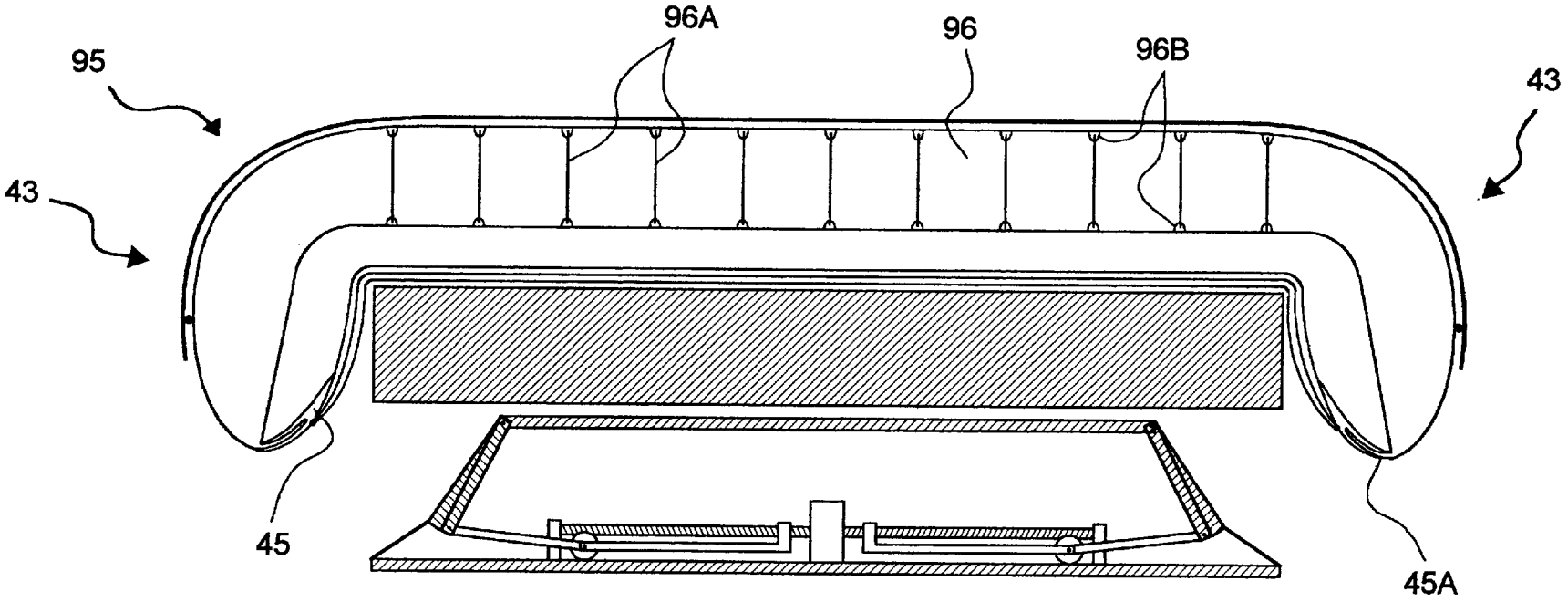

FIG. 15A is a sectional view where a drawstring chamber is inflated.

Figure 16:
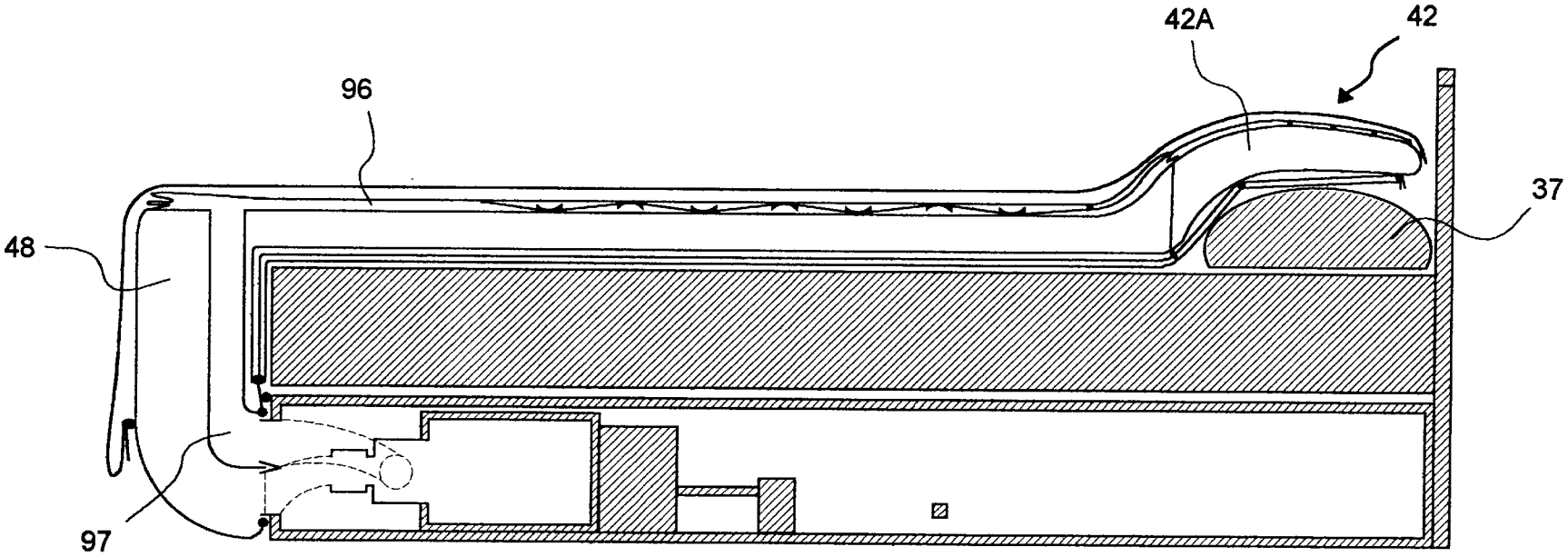

FIG. 16 is a sectional view where the pillow canopy is inflated.

Figure 16A:
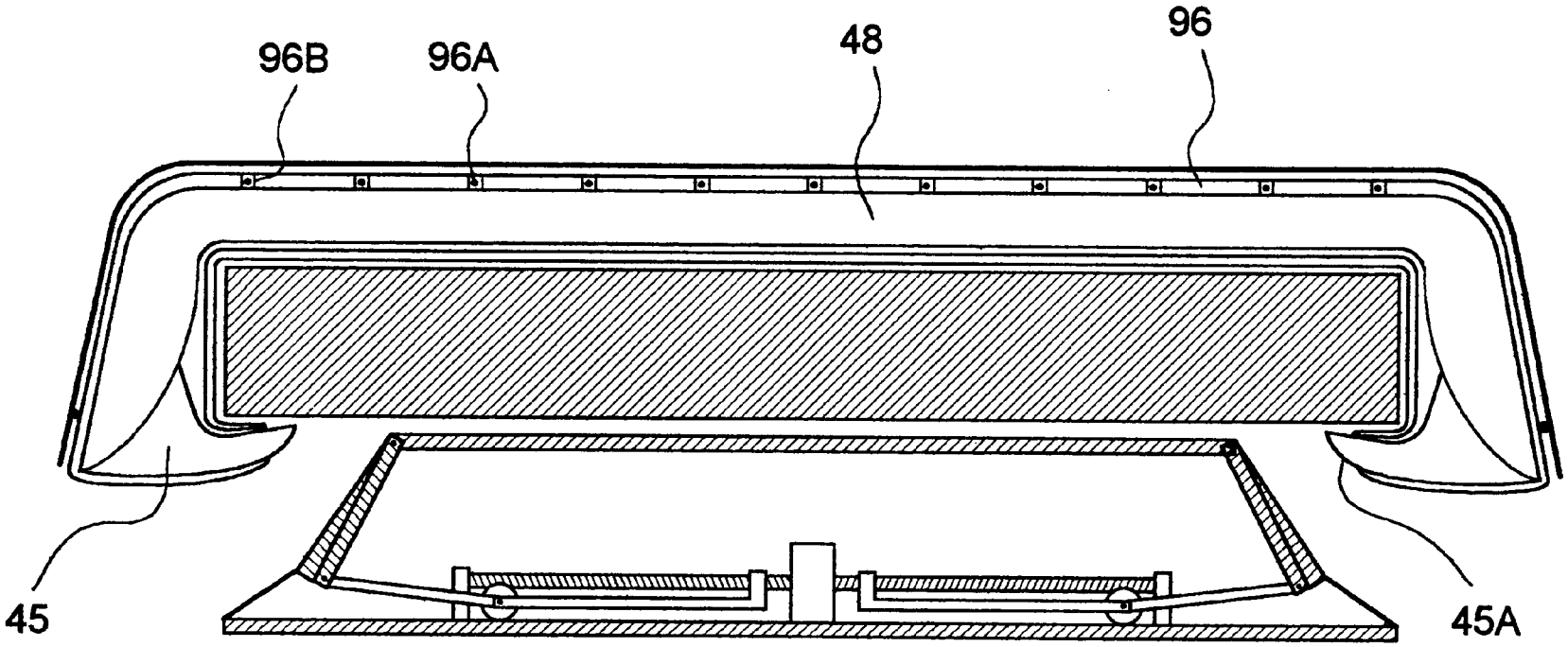

FIG. 16A is a sectional view where the tuck chambers are inflated.

Embodiment with Internal Sliding Chambers

Figure 17:
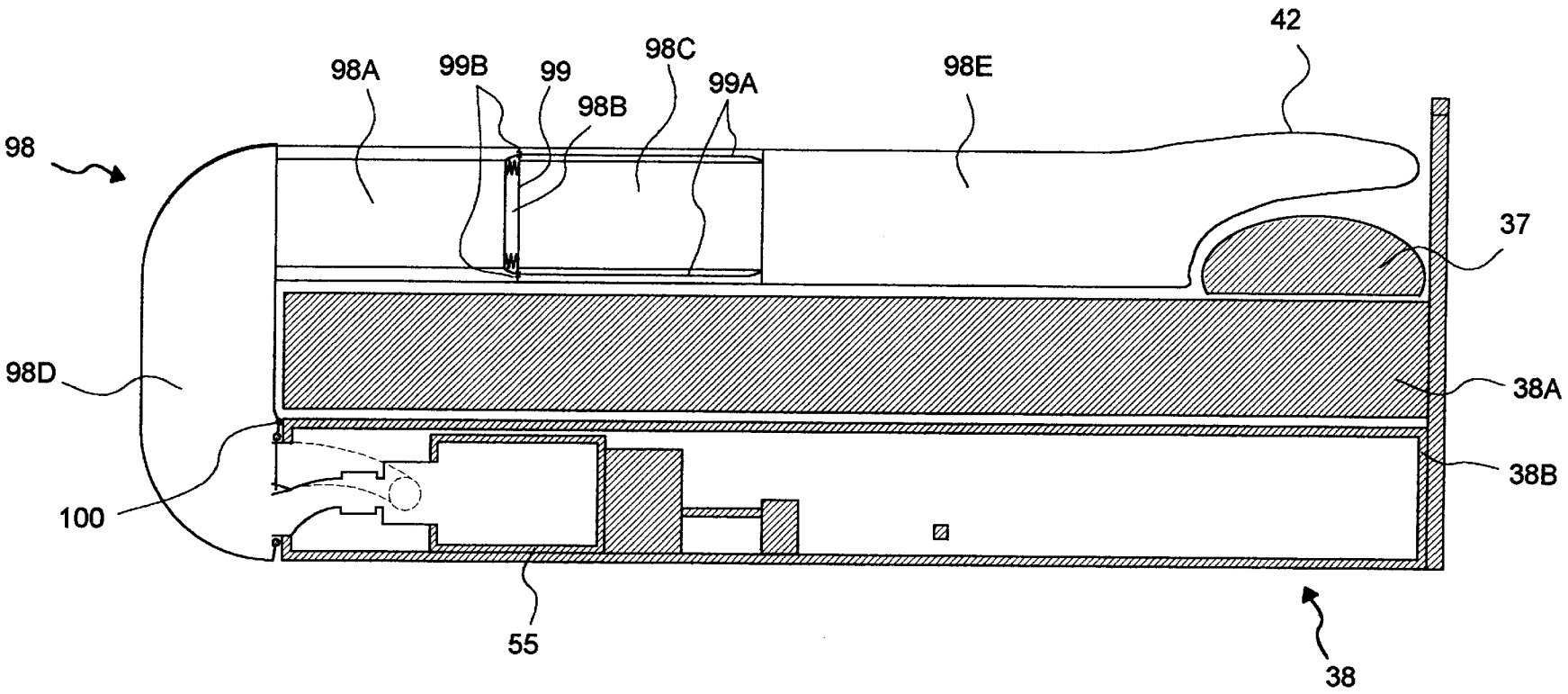

FIG. 17 is a sectional view of a bed-making device according to the invention where the pillow canopy is extended headward.

Figure 17A:
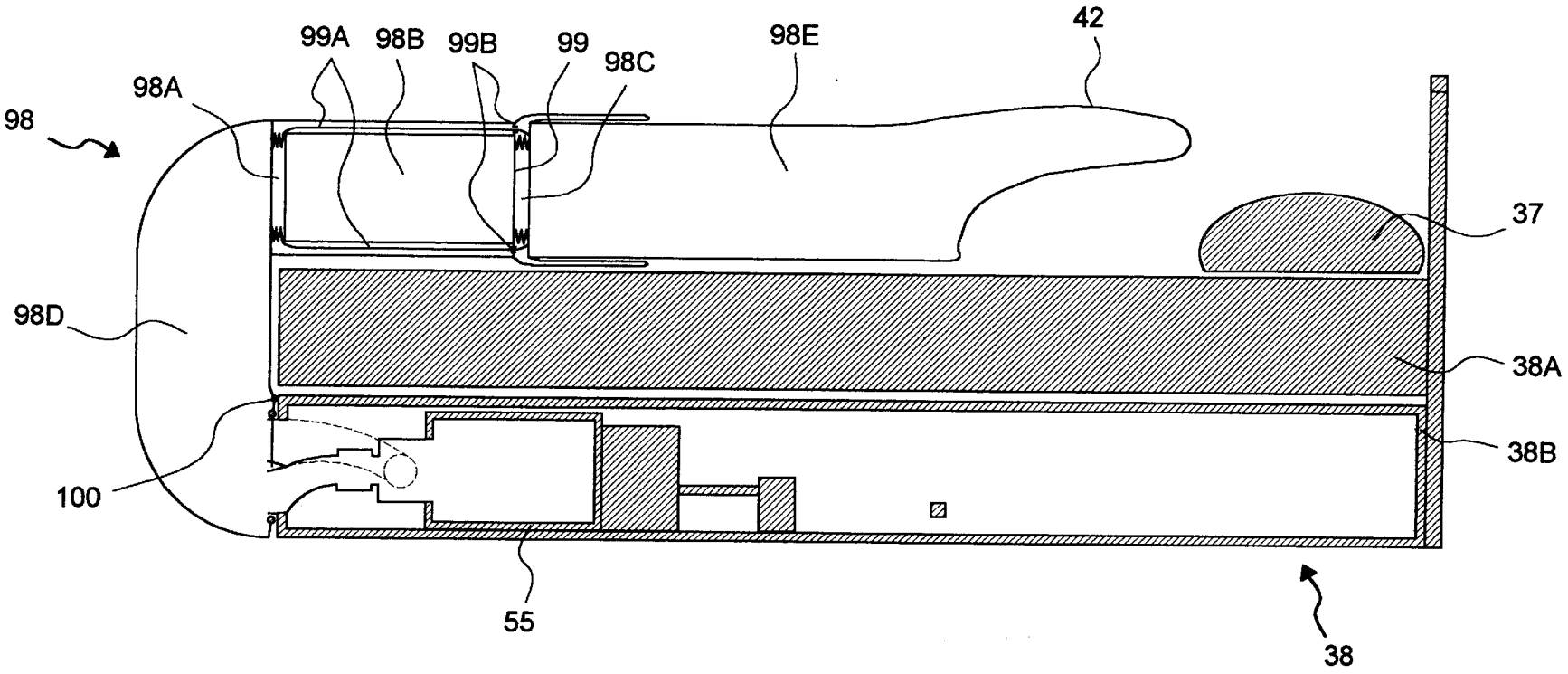

FIG. 17A is a sectional view where the pillow canopy is retracted footward.

Embodiment with Foot-End Retraction Chamber

Figure 18:
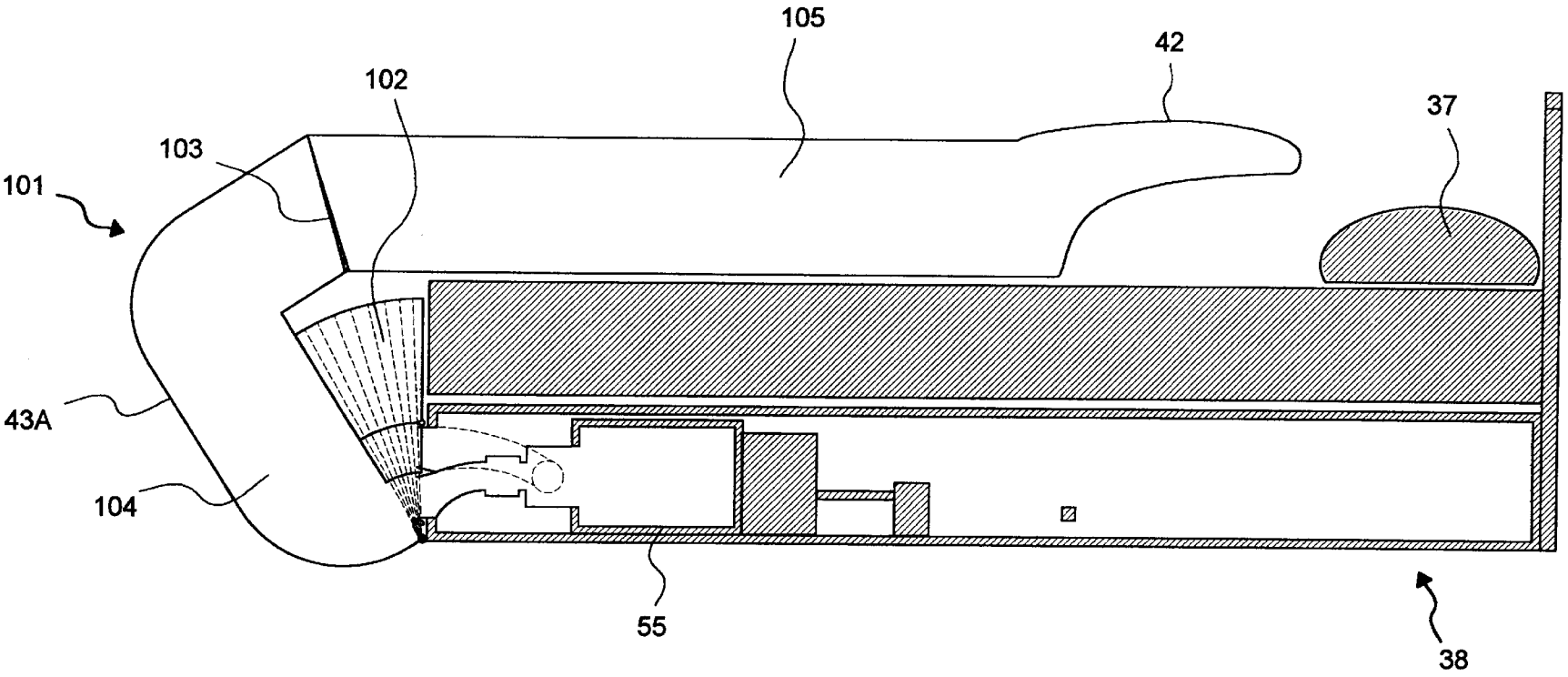

FIG. 18 is a sectional view of a bed-making device according to the invention showing a foot-end retraction chamber inflated.

Figure 18A:
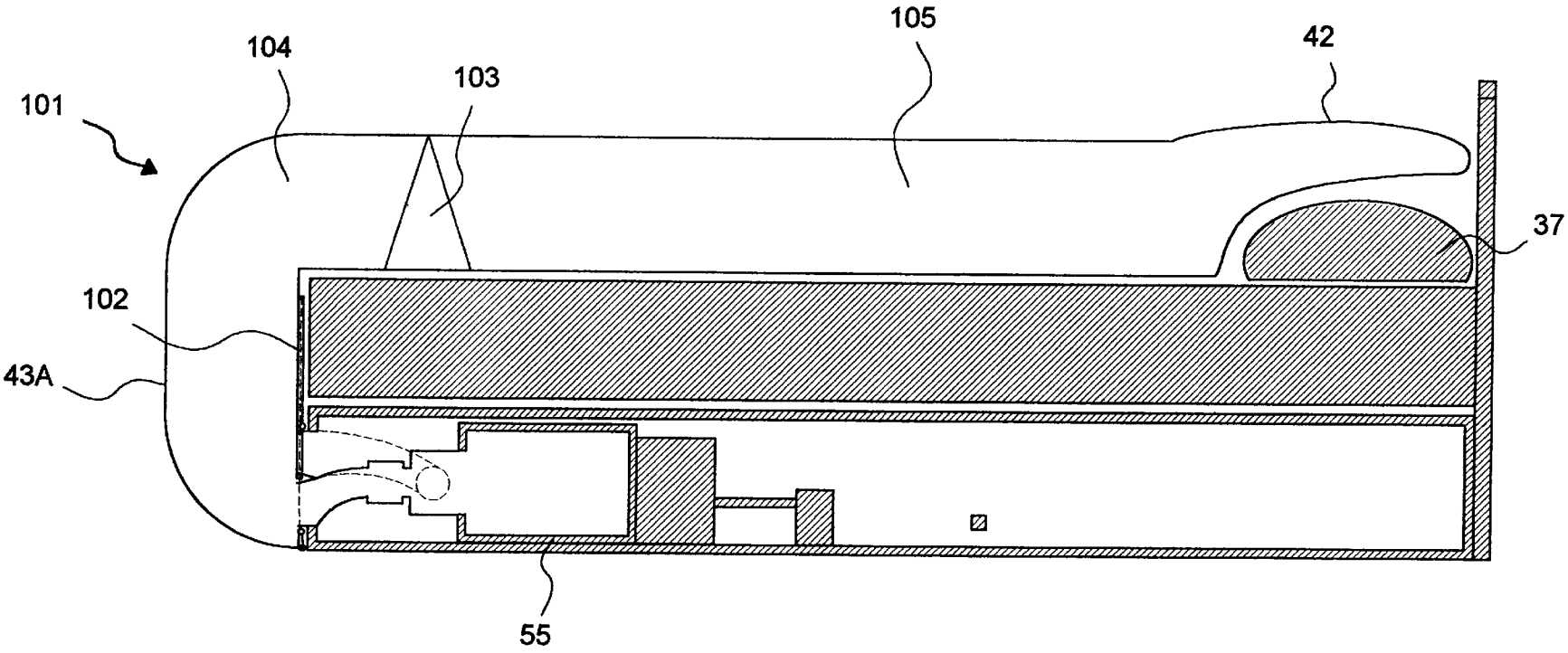

FIG. 18A is a sectional view showing a projection chamber inflated.

Figure 18B:
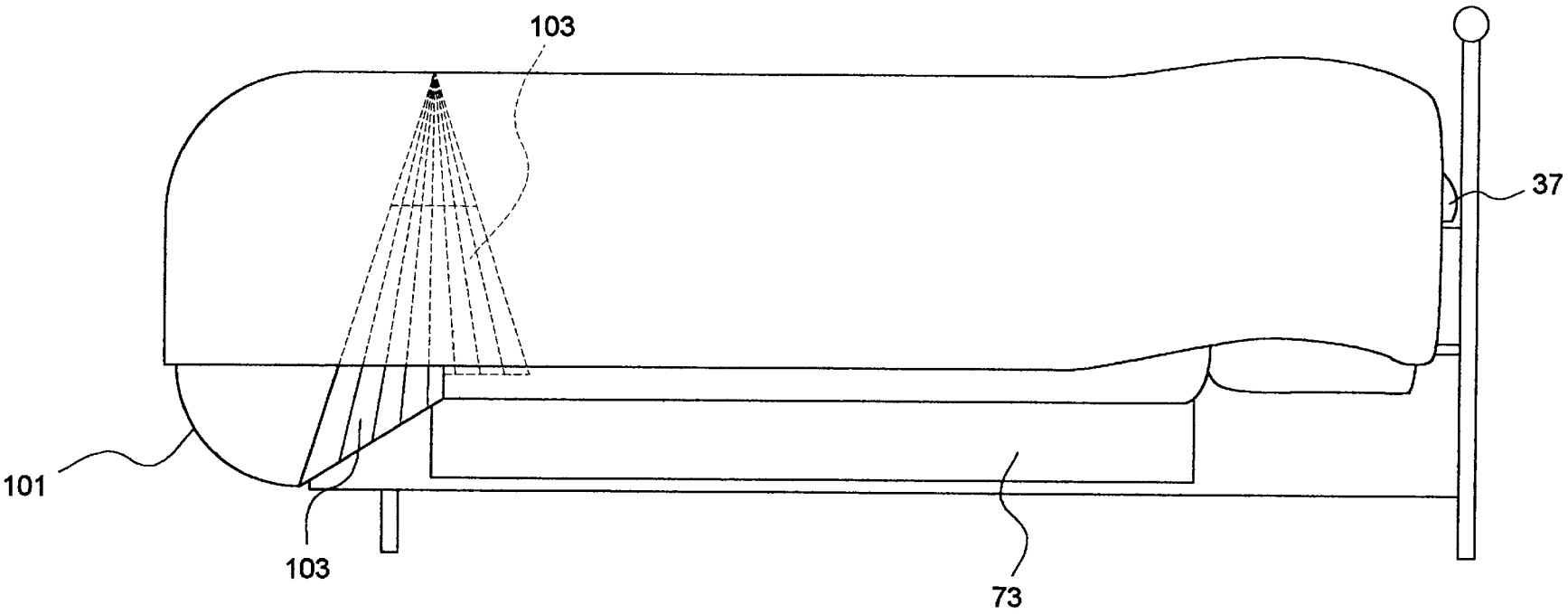

FIG. 18B is a right side view of the inflated projection chamber.

REFERENCE NUMERALS IN DRAWINGS

| | | | |
|---|---|---|---|
| | Basic Version | | |
| 20A | hook-and-loop fastener | 24 | air blower |
| 21 | bed-cover assembly | 24A | electrical cord |
| 21A | outer layer | 24B | start button |
| 21B | top sheet | 24C | automatic self-timer |
| 21C | decorative cloth | 24D | air-pressure-sensor switch |
| 21D | middle layer | 24E | blower port |
| 21E | blanket | 24F | stop |
| 21F | lightweight cloth | 24G | releasable latch |
| 22 | foot space | 26 | bed |
| 23 | inflatable bladder | 26A | mattress |
| 23A | air conduit | 26B | box frame |
| 23B | inflation stringer | 27 | plastic attachment base |
| 23C | vertical overhang | 27A | nubble: |
| 23D | cord | 27B | hook-and-eye fastener |
| 23E | pull tab | | |
| | Preferred Embodiment | | |
| 29 | insulating layer | 55 | air blower |
| 30 | inflatable bladder | 55A | blower inlet port |
| 30A | inflation stringer | 55B | blower outlet port |
| 30B | deflation stringer | 57 | primary-chamber valve |
| 32 | spacer layer | 57A | inlet port |
| 33 | top bed sheet | 57B | exhaust port |
| 35 | bed-cover assembly | 57C | connecting conduit |
| 35A | zipper | 56 | retraction-chamber valve |
| 35B | hook-and-loop fasteners | 58A | inlet port |
| 37 | pillow | 58B | exhaust port |

-continued

| | | | |
|---|---|---|---|
| 38 | bed | 58C | connecting conduit |
| 38A | mattress | 59 | projection-chambers valve |
| 38B | box frame | 59A | inlet port |
| 38C | headboard | 59B | exhaust port |
| 40 | main body | 59C | connecting conduit |
| 42 | pillow canopy | 60 | box-frame port |
| 42A | pillow-canopy chamber | 62A | primary air-pressure sensor |
| 42B | top retraction chamber | 62B | retraction air-pressure sensor |
| 43 | side skirt | 62C | projection air-pressure sensor |
| 43A | foot-end skirt | 63 | electric motor |
| 43B | side retraction chamber | 63A | reversible drive shaft |
| 43C | convex shape | 65 | gear box |
| 45 | tuck chamber | 65A | drive screw |
| 45A | tuck protrusion | 67 | slide arm |
| 47A | retraction-chambers conduit | 67A | track |
| 47B | projection-chambers conduit | 67B | wheel |
| 47C | top port | 68 | lift panel |
| 47D | pillow-canopy conduit | 70 | tuck platform |
| 48 | primary chamber | 70A | elasticized cloth shield |
| 50 | bladder port | 72 | soft resilient material |
| 50A | primary-chamber orifice | 73 | closeable tuck opening |
| 50B | retraction-chambers orifice | 73A | protruding outer corner |
| 50C | projection-chambers orifice | 75 | rod |
| 52 | reinforcing ring | 75L | left projection |
| 52A | grasping tab | 75R | right projection |
| 52B | side stop | 77 | trip switch |
| 52C | top projection | 77A | trip arm |
| 52D | spring latch | 77B | trip-switch cord |
| 52E | rigid eyelet | 78 | ventilating opening |
| 53 | hook-and-eye fastener | 78A | air-porous fabric |
| 54 | electronic control box | 80 | air reservoir |
| 54A | start cord | 82 | cloth ridge |
| 54B | start button | 82A | air channel |
| | Embodiment with Lift Actuators | | |
| 84 | inflatable bladder | 86A | primary-chamber port |
| 85 | lift actuator | 86B | tuck-chambers port |
| 85A | expansion mechanism | 87 | tuck-chambers conduit |
| 85B | hook-and-eye fastener | | |
| | Embodiment with Valved Chamber Walls | | |
| 91 | inflatable bladder | 93 | chamber wall |
| 91A | zipper fastener | 93A | intake valve |
| 91B | expansion section | 93B | exhaust valve |
| 92A | chamber | 94 | chamber wall |
| 92B | chamber | 94A | intake valve |
| 92C | chamber | 94B | exhaust valve |
| | Embodiment with Retraction Drawstrings | | |
| 95 | inflatable bladder | 96B | eyelet |
| 96 | drawstring chamber | 97 | drawstring-chamber conduit |
| 96A | drawstring | | |
| | Embodiment with Internal Sliding Chambers | | |
| 98 | inflatable bladder | 98E | head-end chamber |
| 98A | footward projection chamber | 99 | chamber wall |
| 98B | retraction chamber | 99A | fabric strip |
| 98C | headward projection chamber | 99B | opening |
| 98D | foot-end chamber | 100 | zipper fastener |
| | Embodiment with Foot-End Retraction Chamber | | |
| 101 | inflatable bladder | 104 | foot-end chamber |
| 102 | retraction chamber | 105 | head-end chamber |
| 103 | projection chamber | | |

SUMMARY

In accordance with this invention, a bed-making apparatus comprises an inflatable bladder which is restricted in its movement relative to a bed cover. When the bladder is inflated, the disheveled portions of the bed cover are straightened.

DESCRIPTION

Basic Version

FIGS. 1 to 4B

Figure 1:
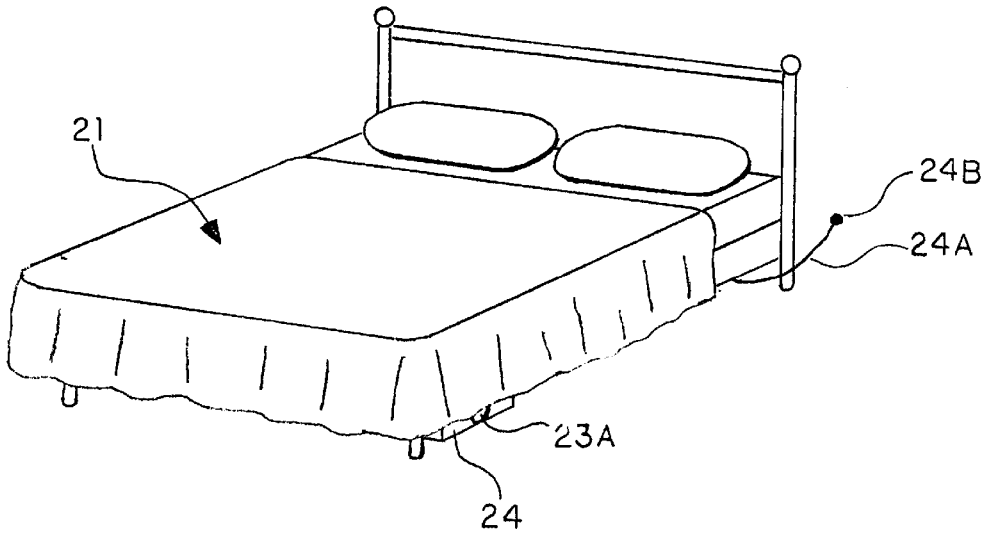
FIG. 1 is a perspective view of a basic version of the bed-making device in accordance with the invention, where the bed is made up and ready for use.
Figure 1A:
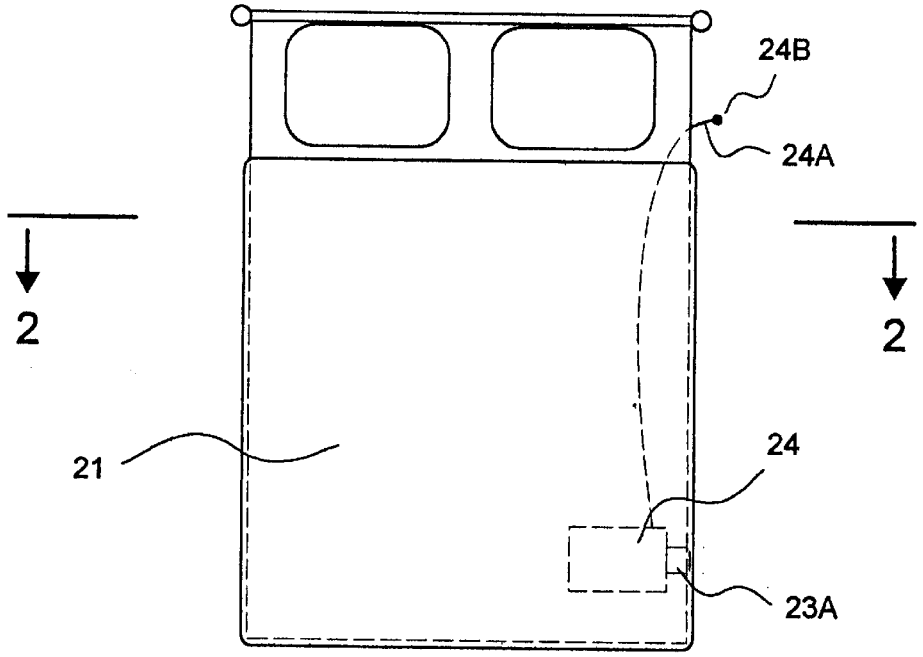
FIG. 1A is an overhead view of the made bed.

A basic version of an automatic bed maker according to the present invention is illustrated in FIGS. 1 to 4B. As shown in FIG. 1, it consists of a bed-covering layer combination or bed-cover assembly 21 connected to an air blower 24 by means of a conduit 23A. An electrical cord 24A and a start button 24B are connected to blower 24. FIG. 1A is an overhead view of FIG. 1 showing the section lines for FIG. 2.

Figure 2:
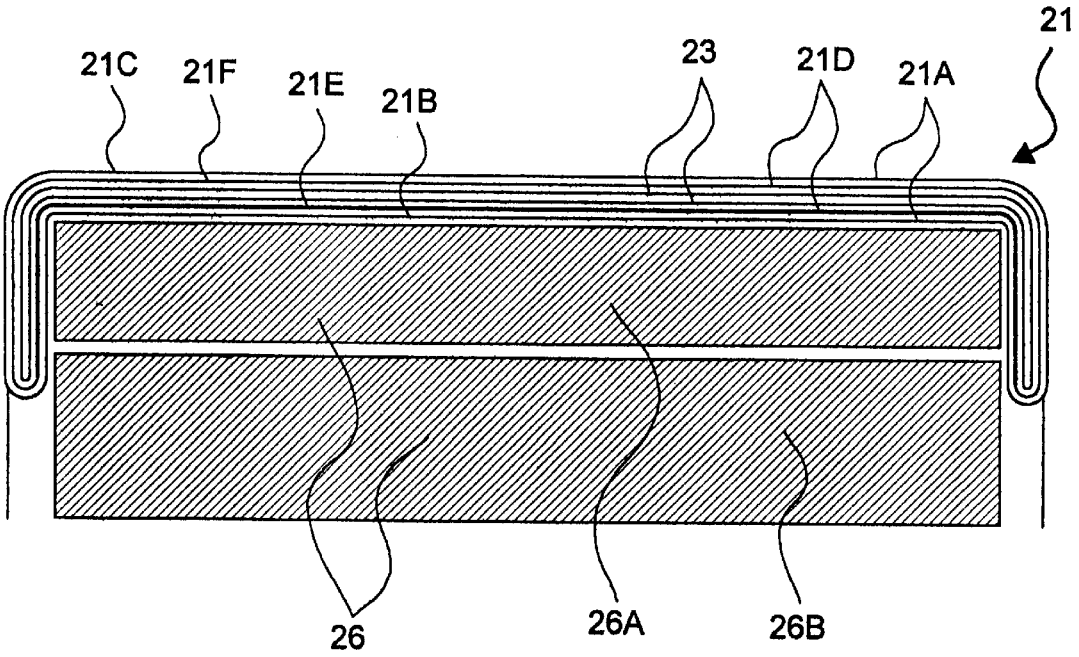
FIG. 2 is a sectional view of a bed-cover assembly.

FIG. 2 shows a cross section of assembly 21 which consists of three bed covering layers. An outer layer 21A encases a middle layer 21D. Middle layer 21D encases a rectangular inflatable sack, inflatable bag, or inflatable bladder 23. Bladder 23 is used to straighten and position the other layers of assembly 21. Outer layer 21A includes a top sheet 21B on its lower side and a lightweight decorative cloth 21C on its upper side. Middle layer 21D includes a blanket 21E on its lower side and a lightweight cloth 21F on its upper side.

Outer layer 21A, middle layer 21D, and bladder 23 rest squarely and evenly over a bed 26, which consists of a mattress 26A and a box frame 26B. Outer layer 21A and middle layer 21D are sized so they are pulled taut by bladder 23 when it is fully inflated. (Because bladder 23 is encased by the bed-cover layers, bladder 23 is restricted in being displaced from them.

Figure 3:
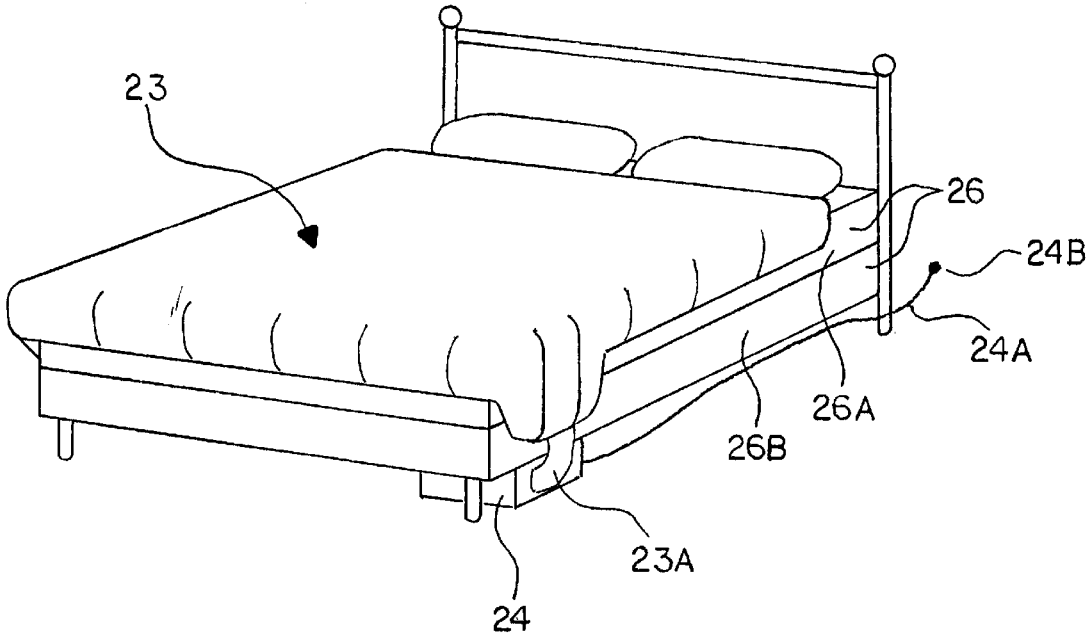
FIG. 3 is a perspective view where an outer layer and a middle layer of the bed-cover assembly are removed to show the shape of an inflated bladder within the bed-cover assembly.
Figure 3A:
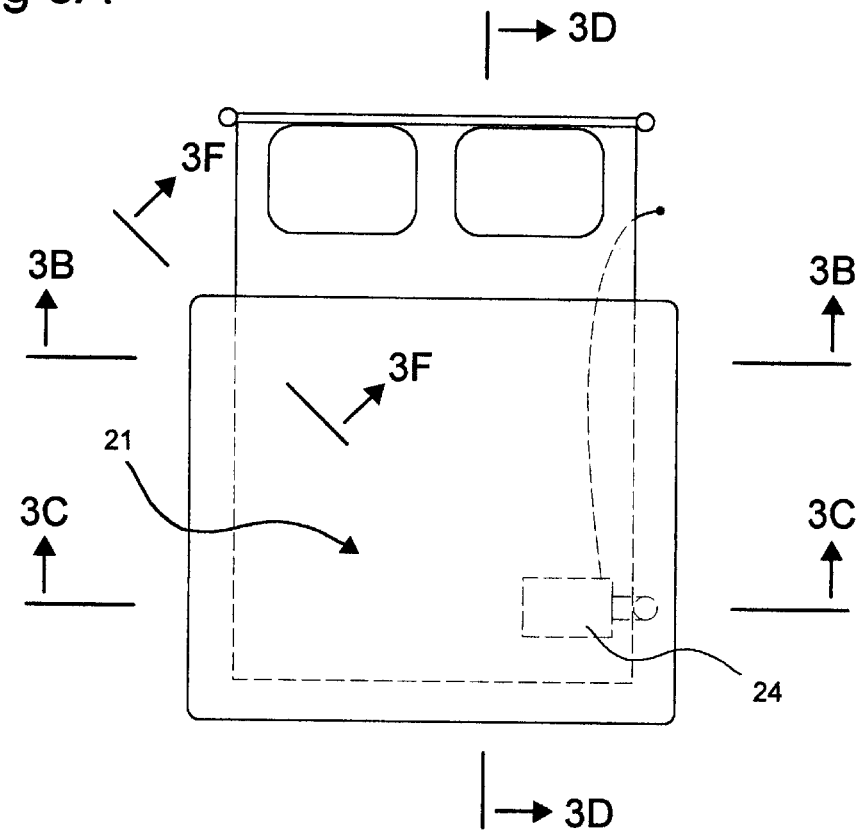
FIG. 3A is an overhead view of the inflated bed-cover assembly.
Figure 3B:
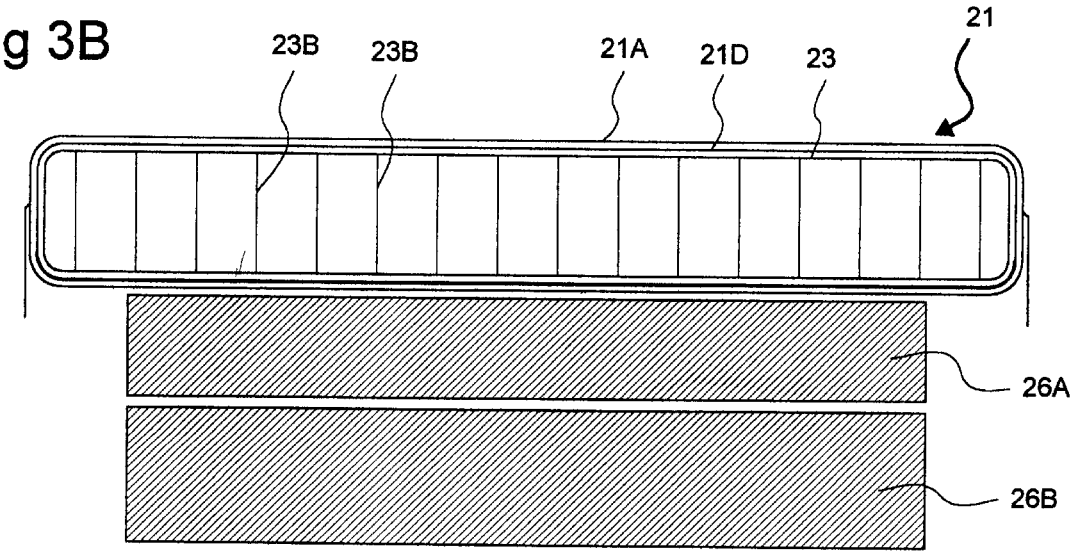
FIG. 3B is a sectional view toward the head end of the bed.
Figure 3C:
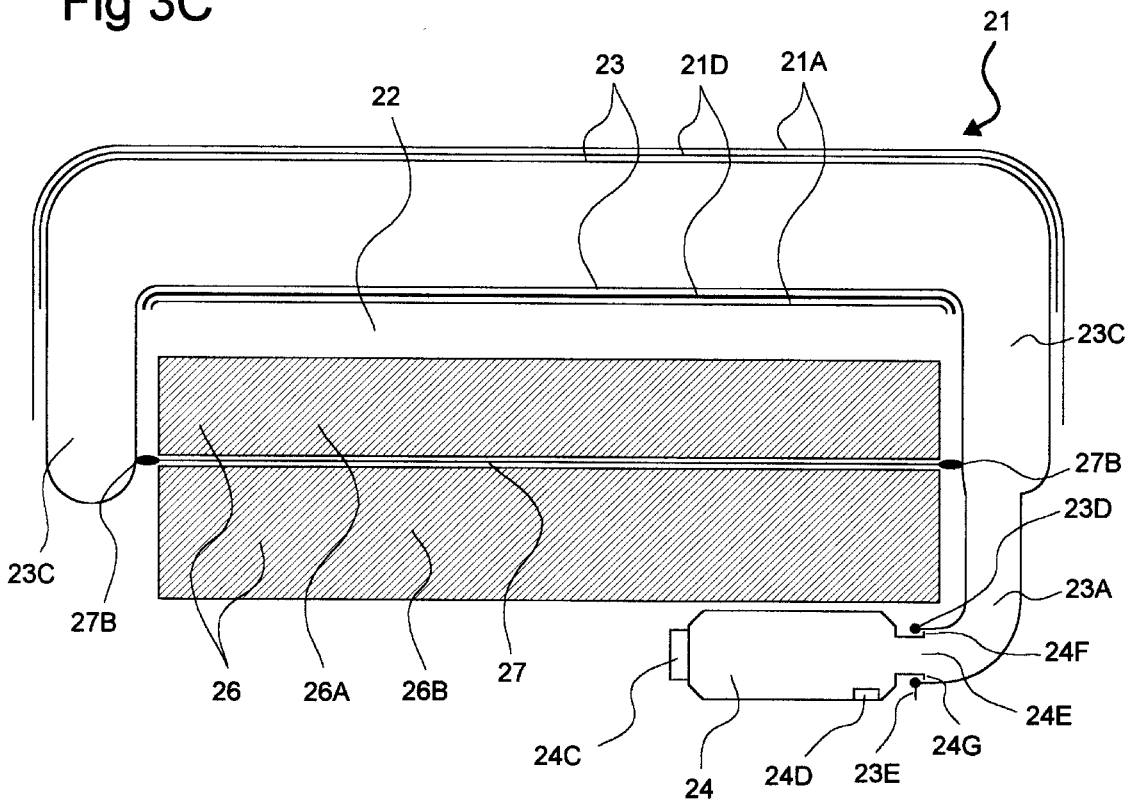
FIG. 3C is a sectional view toward the foot end of the bed.
Figure 3D:
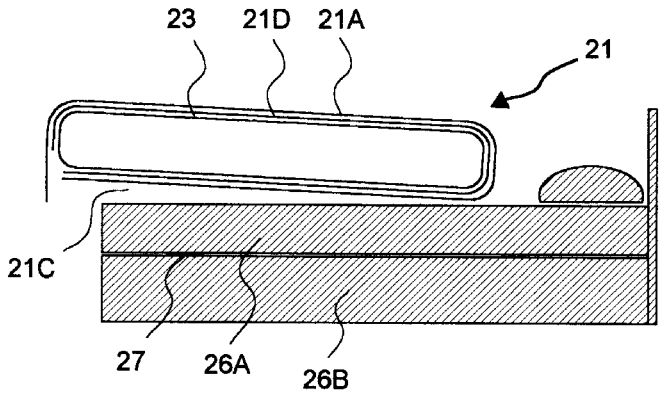
FIG. 3D is a sectional view running from the head end to the foot end of the bed.

In FIGS. 3 to 3D, bladder 23 is fully inflated. In FIG. 3, outer layer 21A and middle layer 21D are removed so the contours of bladder 23 may be seen more clearly. Bladder 23 extends beyond the left side, right side, and foot end of mattress 26A by 5 cm to 25 cm. The amount bladder 23 extends beyond mattress 26A is proportional to the size of bed 26 and the preferences of the user. FIG. 3A is an overhead view showing assembly 21 under inflation. It indicates the section lines for FIGS. 3B, 3C, 3D and 3F.

When bladder 30 is inflated, it tends to become rounded in shape, in at least one of its three dimensions. To counteract this, and create the shape indicated in the above description, an array of inflation stringers 23B (FIG. 3B) constructed of thread, are attached to the inner surfaces of bladder 23. Each inflation stringer 23B limits the distance that each of its end anchor points on the two inner-membrane surfaces may move away from the other.

Figure 3E:
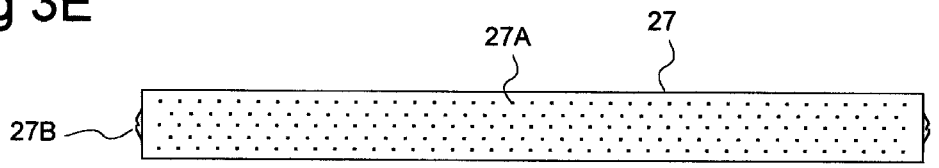
FIG. 3E is an overhead view of a plastic attachment base.

FIG. 3C is a vertical cross section toward the foot end of bed 26. It shows how assembly 21 is anchored to bed 26. Bladder 23 has a portion which extends down vertically from the left and right sides of its main body, forming a vertical overhang 23C on each side. A flat strip of semi-flexible plastic forms an attachment base 27. FIG. 3E shows an overhead view of attachment base 27. Attachment base 27 (FIGS. 3C and 3E), which is 20 cm wide is lodged in bed 26 between mattress 26A and box frame 26B. It extends from the left side of bed 26 to the right. Attachment base 27 is positioned 30 cm from the foot end of mattress 26A. An array of small projections or nubbles 27A protrude from, and extend down, the full length of the upper and lower surfaces of attachment base 27. They provide friction to resist dislodging of attachment base 27 from its position between mattress 26A and box frame 26B. Attachment base 27 is fastened to vertical overhangs 23C by means of a left and right, latched, hook-and-eye fastener 27B. The hook portion is designed so that its latch must be depressed for it to be separated from the eye portion.

Conduit 23A extends from the apex of the lower contour of right vertical overhang 23C of bladder 23 to its coupling with a blower port 24E on blower 24. Conduit 23A serves as the inflation port and the deflation port for bladder 23. Fabricated into the rim of conduit 23A is a flexible, non-elastic cord 23D. Extending down from the edge of cord 23D is a pull tab 23E. Blower port 24E has a stop 24F projecting from the rim of its upper surface, and a releasable latch 24G built into the rim of its lower surface. Bladder 23 and conduit 23A are constructed of a thin, flexible, strong, lightweight, fluid-impermeable membrane that would be appropriate in human clothing. Blower 24 includes an automatic self-timer 24C and a air-pressure-sensor switch 24D. Blower 24 delivers 90 cfm at 2 psi. Air-pressure-sensor switch 24D is designed to cut off power to blower 24 when the inflation pressure reaches 1.5 psi.

When inflated, vertical overhangs 23C hold the foot-end area of assembly 21 up and away from bed 26. This creates unfolding room and a foot space 22 between mattress 26A and assembly 21. As FIG. 3D shows, the foot ends of outer layer 21A and middle layer 21D are open to allow the insertion of middle layer 21D and bladder 23 respectively, when assembling them together. The outward-facing surfaces of headward area of middle layer 21D and bladder 23 are made of low-friction fabric.

Figure 3F:
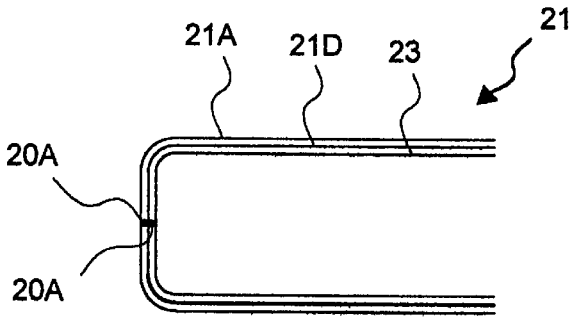
FIG. 3F is a sectional view of the left head-end corner of the bed-cover assembly.

FIG. 3F is a sectional view of the left head-end corner of inflated assembly 21. The right head-end corner is a mirror image of the left. Outer layer 21A, middle layer 21D, and bladder 23 are attached together at those corners by a hook-and-loop fastener 20A.

OPERATION

Basic Version

FIGS. 1 to 4B

When bed 26 has been slept in, assembly 21 (FIG. 4A) may be disheveled or crumpled and pushed toward the foot of bed 26. The head edge of assembly 21 may be folded back over or under itself.

Figure 4A:
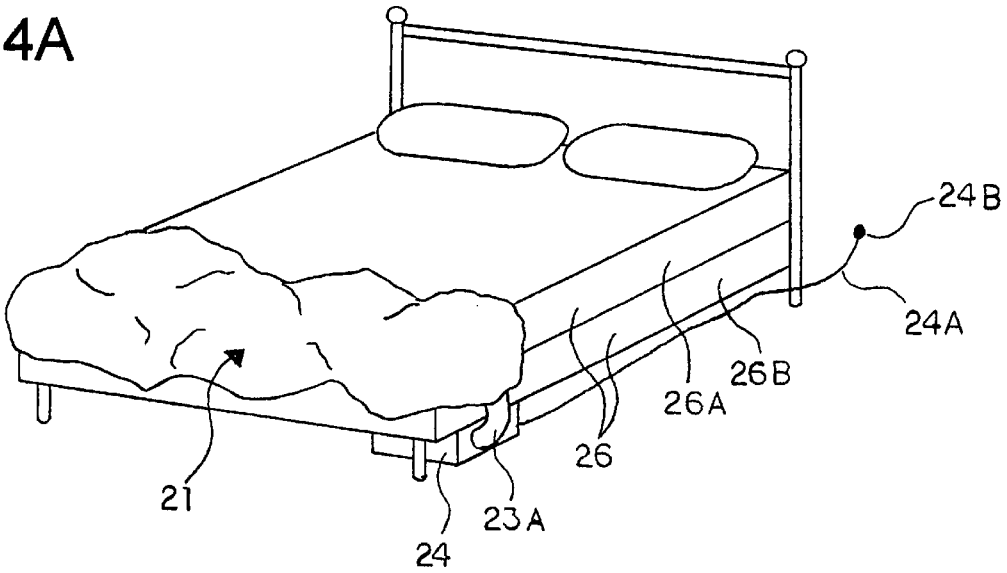
FIG. 4A is a perspective view of the bed-cover assembly after it has been used and is in a disheveled state.
Figure 4B:
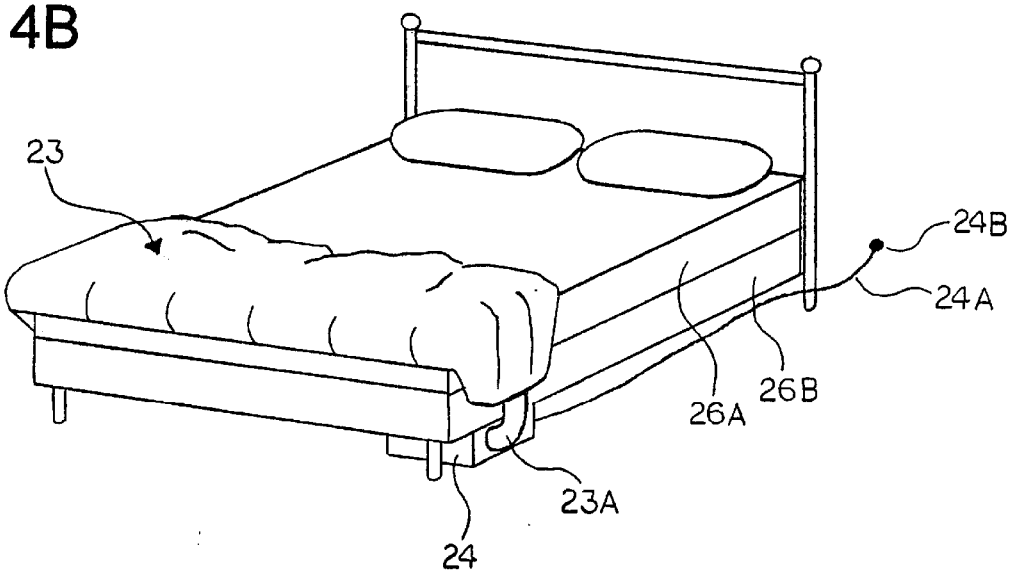
FIG. 4B in a perspective view of the partially inflated bladder with the outer and middle layers of the bed-cover assembly removed.

To operate, the resting person arises and pushes start button 24B (FIGS. 4A and 4B. FIG. 4B is shown without middle layer 21D and outer layer 21A. Blower 24 begins inflating bladder 23 with air through conduit 23A. Bladder 23 billows out at the foot end and begins billowing forward toward the head of bed 26. Any leading edge of assembly 21 folded back over the rest of assembly 21 will straighten or unravel without interference. The leading edge of assembly 21 folded under the rest of assembly 21 either pulls itself forward by the billowing action of bladder 23, or fills with air and rotates out from underneath. The crumpled, disheveled, disordered, and dislocated parts of the bed covers are thus repositioned by being moved toward where their proper, ordered, or made positions will be when bladder 23 is deflated.

Attachment base 27 (FIGS. 3C and 3E) is held firmly in one position by the weight of mattress 26A against nubbles 27A and box frame 26B. Because vertical overhangs 23C are attached by hook-and-eye fasteners 27B to attachment base 27, they begin to elevate the foot-end area of assembly 21 away from mattress 26A as they inflate. This lifting of assembly 21 creates foot space 22 (FIG. 3D) and aids in freeing and straightening the portions of the bed covers which are crumpled, folded, or disheveled underneath. Foot space 22 also provides room for the feet after bladder 23 is deflated and bed 26 is made. The covers that rotate out by swinging down and around, have more friction on their outer surface and forward edge. Therefore, it is beneficial to use lower-friction fabric on these surfaces.

As bladder 23 (FIG. 3C) approaches full inflation, the aligning forces engage. Vertical overhangs 23C are firmly anchored to bed 26 by attachment base 27, and are an integral part of assembly 21. This anchoring therefore sets a predetermined angular relationship of the bed covering layers with bed 26. As vertical overhangs 23C become rigid with inflation, they rotate the unaligned parts of assembly 21 into alignment with bed 26. The bedward facing surfaces of assembly 21 stop assembly 21 from moving in a bedward direction. Thus they serve as abutting surfaces. They include the bedward sides of vertical overhangs 23C and the underside of the main area of assembly 21. Additional alignment pressure is caused because left and right vertical overhangs 23C squeeze bed 26 between them.

After maximum inflation occurs, blower 24 is automatically shut off by air-pressure-sensor switch 24D. Self-timer 24C acts as a safety backup to shut off blower 24 if full-inflation pressure is not achieved within three minutes. Bladder 23 then deflates from automatic back-drafting through blower 24, and the bed covers settle down into their correct made positions (FIG. 1).

Outer layer 21A (FIG. 3C), middle layer 21D, and bladder 23 may be periodically removed for changing or cleaning. Releasable latch 24G is depressed and pull tab 23E is grasped to remove conduit 23A from blower port 24E. Hook-and-eye fasteners 27B are unhooked and hook-and-loop fasteners 20A are separated. Middle layer 21D (FIG. 3D) is pulled out from the foot end of outer layer 21A, and bladder 23 is pulled out from the foot end of middle layer 21D. To reassemble, the above steps are performed in reverse.

DESCRIPTION

Preferred Embodiment

FIGS. 5 to 10A

A preferred embodiment of the automatic bed maker is illustrated in FIGS. 5 through 10A. Advantages of this version over the basic version are:

It extends the bed covers over the pillows.

It automatically tucks in the covers.

It is very accurate in aligning the covers with the bed.

It includes ventilation of the covers for greater comfort.

FIG. 5 shows the preferred embodiment after the bed making cycle is complete and deflation has occurred. FIGS. 6 to 10A show the preferred embodiment with its bladder in various stages of inflation. FIG. 6A is an overhead view showing the section lines for FIGS. 6D and 6E. FIG. 8A is an overhead view showing the section lines for FIGS. 6B. FIG. 6B shows the sectioning lines for FIG. 6C. FIG. 6A shows a pair of pillows 37 at the headward end of a bed 38.

FIG. 6D shows a bed-cover assembly 35. It includes three bed covers and an inflatable bladder 30 (or inflatable bag or inflatable sack). The bottom bed cover is a top bed sheet 33 which provides comfort to the touch. The bed cover above sheet 33 is a spacer layer 32. The layer above that is bladder 30. The top layer is the third bed cover such as a blanket, comforter, quilt, or insulating layer 29. Bed 38 consists of a mattress 38A, a box frame 38B, and a headboard 38C.

The bed-covering layers of assembly 35 are placed one over the other, rather than one encasing the other as in assembly 21 of the basic version. They are releasably fastened along their periphery areas by a zipper 35A. In addition, an arrangement of hook-and-loop fasteners 35B fasten the lower surface of bladder 30 to spacer layer 32, and the lower surface of spacer layer 32 to sheet 33. By fastening each layer to the next, bladder 30 is restricted in how much it may be displaced from the attached bed covers.

Bladder

FIGS. 6B to 6F

A main body 40 (FIG. 6D) is the area of assembly 35 which is over the upper surface of bed 38 and is footward of pillows 37. A pillow canopy 42 of assembly 35 extends from main body 40 over pillows 37. A pillow-canopy chamber 42A of assembly 35 is contained within pillow canopy 42. A foot-end skirt 43A extends down from main body 40 along the foot end of bed 38.

FIG. 6C is a sectional view showing a left and right side skirt 43 which extend down from main body 40 and overlap the left and right sides of bed 38. The surface of side skirt 43 facing in toward the bed is a convex shape 43C. A side retraction chamber 43B is inflated and extends along the outer area of side skirt 43. In FIG. 6E, side retraction chamber 43B is deflated and a tuck chamber 45 which extends along the lower inner edge of side skirt 43 is inflated. Tuck chamber 45 is shaped to create a shelf-like tuck protrusion 45A along the left and right side periphery areas of the bed covering layers, when inflated. Tuck protrusion 45A protrudes in toward the middle of bed 38. The lower edge of the outer membrane of side retraction chamber 43B is attached to tuck protrusion 45A to retract it back against side skirt 43 when tuck chamber 45 is deflated and side retraction chamber 43B is inflated.

FIG. 6B shows pillow-canopy chamber 42A deflated and a top retraction chamber 42B inflated. Top retraction chamber 42B is attached to pillow canopy 42 to retract it back away from pillows 37 when top retraction chamber 42B is inflated and pillow-canopy chamber 42A is deflated.

A bladder port 50 passes through the inward-facing wall of foot-end skirt 43A. Bladder port 50 serves as both an inflation port and deflation port for bladder 30. FIG. 6F is an enlarged frontal view of bladder port 50 only. It shows that bladder port 50 contains three orifices or subordinate ports. They are a primary-chamber orifice 50A, a retraction-chambers orifice 50B, and a projection-chambers orifice 50C. Within the rim of bladder port 50 is sewn a rigid reinforcing ring 52. A rigid eyelet 52E projects in a bedward direction from the upper edge of reinforcing ring 52. A rigid grasping tab 52A extends down from the lower edge of reinforcing ring 52.

Main body 40 (FIG. 6D) and foot-end skirt 43A together contain a primary chamber 48 of bladder 30. Primary-chamber orifice 50A is the inlet/outlet port for primary chamber 48.

Air Passage Routes

FIGS. 8A to 8D

FIGS. 8A to 8D show the routes for air to pass from bladder port 50 to the remaining bladder chambers. Retraction-chambers orifice 50B (FIG. 8A) is the inlet/outlet port for a pair of retraction-chambers conduits 47A. Retraction-chambers conduits 47A are connected to side retraction chambers 43B. A top port 47C opens through the top headward membrane of side retraction chambers 43B (FIG. 8B) into the lower side of top retraction chamber 42B.

Projection-chambers orifice 50C (FIG. 8C) is the inlet/outlet port for a pair of projection-chambers conduits 47B. Projection-chambers conduits 47B are connected to tuck chambers 45. A pair of pillow-canopy conduits 47D (FIG. 8D) connect tuck chambers 45 to pillow-canopy chamber 42A.

Air Supply

FIG. 7 and 7A

FIG. 7 shows a horizontal cross section of box frame 38B from FIG. 6D. An electronic control box 54 is mounted inside box frame 38B and is programmed to control the sequence of steps for the making of bed 38. An electrical start cord 54A runs from control box 54 to a start button 54B which emerges near the head end of box frame 38B.

An air blower 55, electrically controlled by control box 54, is mounted within box frame 38B. Blower 55 has a blower inlet port 55A and a blower outlet port 55B. Blower outlet port 55B is connected to three valves. FIG. 7A is an enlarged view of these three valves. They are a primary-chamber valve 57, a retraction-chambers valve 58, and a projection-chambers valve 59. Primary-chamber valve 57 has a inlet port 57A and an exhaust port 57B. Retraction-chambers valve 58 has a inlet port 58A and an exhaust port 58B. Projection-chambers valve 59 has a inlet port 59A and an exhaust port 59B. Primary-chamber valve 57, retraction-chambers valve 58, and projection-chambers valve 59 are connected to a connecting conduit 57C, a connecting conduit 59C, and a connecting conduit 59C respectively. Connecting conduit 57C, connecting conduit 58C, and connecting conduit 59C contain a primary air-pressure sensor 62A, a retraction air-pressure sensor 62B, and a projection air-pressure sensor 62C respectively. Connecting conduits 57C, 58C, and 59C are connected to a multi orifice box-frame port 60. Box-frame port 60 (FIG. 7) is releasably coupled or attached to bladder port 50.

Primary-chamber valve 57, retraction-chambers valve 58, and projection-chambers valve 59 are electrically controlled by control box 54. Control box 54 is designed to sense changes in air pressure within the three channels through their respective air-pressure sensors. Control box 54 is thus able to modulate the various inflation pressures within the chambers of bladder 30.

Attachment to Bed

FIGS. 6D, 6F, and 6G

FIG. 6G is an enlarged frontal view of box-frame port 60 only. Box-frame port 60 has a pair of side stops 52B and a top projection 52C extending radially from its outer rim. Built into the bottom of its outer rim is a spring latch 52D. When bladder port 50 (FIG. 6F) is attached to box-frame port 60, eyelet 52E sits over top projection 52C, reinforcing ring 52 abuts side stops 52C, and latch 52D catches the bottom of reinforcing ring 52. The purpose of reinforcing ring 52, grasping tab 52A, side stops 52B, top projection 52C, and latch 52D is to couple bladder port 50 to box-frame port 60. They also act as a fastener to attach and anchor the bed-covering layers to bed 38.

Assembly 35 (FIG. 6D) is also attached to bed 38 at the left and right upper foot-end corners of box-frame 38B by a hook-and-eye fastener 53.

Tuck Mechanism

FIGS. 6C and 7

FIG. 6C and FIG. 7 show the configuration of the tuck mechanism. In FIG. 7, an electric motor 63, which is electrically controlled by control box 54, is mounted adjacent to blower 55. Motor 63 has a reversible drive shaft 63A extending headward to a gear box 65 (FIGS. 6C and 7). Gear box 65 transfers the rotational energy of drive shaft 63A to a left and right drive screw 65A which are perpendicular to drive shaft 63A. Motor 63 and gear box 65 are designed to turn drive screws 65A at 360 rpm. The threads of drive screw 65A pass through a v-shaped slide arm 67. Slide arm 67 is supported by a pair of wheels 67B which roll in a pair of tracks 67A. The forward edges of slide arm 67 are hinged to a lift panel 68 at wheels 67B.

FIG. 6C shows that the outside edge of lift panel 68 is hinged to the outside lower edge of a tuck platform 70. The inner edge of tuck platform 70 is hinged to the inside upper edge of box frame 38B. When tuck platform 70 is lowered, it creates a closeable tuck opening 73. An elasticized cloth shield 70A is attached to the outside upper edge of tuck platform 70. The opposite edge of cloth shield 70A is attached to the outside lower edge of tuck opening 73. The upper layer of tuck platform 70 is made of a soft resilient material 72 such as rubber. The upper surface of tuck platform 70 and the lower perimeter surface of mattress 38A are of a type that produce some frictional resistance with assembly 35 when they are in contact with it.

At the head and foot ends of tuck opening 73 is a protruding outer corner 73A (FIG. 7). Outer corners 73A are made of resilient material 72. The headward and footward ends of lift panel 68 and tuck platform 70 are also made of resilient material 72.

A rod 75 with a left projection 75L and a right projection 75R is attached to right slide arm 67 so it is parallel with right drive screw 65A. A trip switch 77 is mounted within box frame 38B so a trip arm 77A extending from it may be alternately depressed by left projection 75L and right projection 75R. An electrical trip-switch cord 77B runs from trip switch 77 to control box 54.

Ventilation

FIGS. 6B and 9

To provide greater comfort, a ventilating opening or openings may be built through bladder 30 so moisture can escape and fresh air can migrate in. FIGS. 6B and 9 show the location of a rectangular ventilating opening 78 in the middle of bladder 30. As FIG. 6B shows, an air-porous fabric 78A stretches across the upper and lower outlets of ventilating opening 78. Air-porous fabric 78A is contiguous with the upper and lower surfaces of bladder 30. Air-porous fabric 78A is of a type that allows air and moisture to circulate through the porosity of its weave, and thus through ventilating opening 78. Ventilating opening 78 therefore facilitates the displacement of accumulations of like gaseous molecules away from between bladder 30 and bed 38, to ambient air.

Air Channels

FIGS. 9 and 9A

FIG. 9A is a cross section of a portion of sheet 33, spacer layer 32, and the lower membrane of bladder 30. As shown, a series of cloth ridges 82 are fabricated onto spacer layer 32. Between cloth ridges 82, a series of air channels 82A are thus formed. Air channels 82A act as pathways for the displacement and dispersion of the gaseous molecules of moisture and stale air from areas of higher concentration to areas of lower concentration. One area of higher concentration is around the body of the user. FIG. 9 shows cloth ridges 82 arranged so air channels 82A converge into the area underneath ventilating opening 78.

Because of the porous nature of sheet 33 (FIG. 9A), a thickness of air, or an air reservoir 80 exists between the lower membrane of bladder 30 and the resting person's or user's body. Within its exterior outline, spacer layer 32 has a number of voids, such as air channels 82A, which are filled with air. Including spacer layer 32 in assembly 35 therefore enlarges the volume of air for air reservoir 80. Thus the concentrations of moisture and stale air are diluted and comfort is enhanced.

Modifying the Bladder's Shapes and Contours

FIG. 10

FIG. 10 shows a cross section of bladder 30 taken along the same sectional plane as FIG. 6D. An arrangement of inflation stringers 30A and deflation stringers 30B extend across the interior of bladder 30 from one point on its inner membrane surface to another. Inflation stringers 30A limit the outward spread of bladder 30 and its chambers when they are inflated. Deflation stringers 30B limit the outward and downward spread of bladder 30 and its chambers when they are deflated. Inflation stringers 30A and deflation stringers 30B therefore help define the shape and contours of bladder 30 and its chambers when they are inflated and deflated.

OPERATION

Preferred Embodiment

FIGS. 5 to 10A

After the user has arisen from bed 38, the operator presses start button 54B. The operator may then leave while the bed-making or bed-cover arranging apparatus "makes the bed".

Releasing the Tucked in Bed Covers

FIGS. 6C and 7

When control box 54 (FIG. 7) receives the start signal from start button 54B through start cord 54A, it starts motor 63. Drive shaft 63A begins turning drive screws 65A through the gearing in gear box 65. Drive screws 65A pull slide arms 67 inward, which causes attached lift panels 68 to retract tuck platform 70 (FIG. 6C) downward. This retraction releases any bed-covering layers which have been tucked in and creates tuck opening 73 in bed 38. Rod 75 (FIG. 7) moves leftward until right projection 75R depresses trip arm 77A of trip switch 77. Trip switch 77 then signals control box 54 through trip-switch cord 77B to stop motor 63 and reset drive shaft 63A to turn in the opposite direction.

Positioning and Aligning the Bed Covers

FIGS. 6B, 6C, 7, 7A, 8A, and 10A

Simultaneously with the retraction of tuck platform 70 (FIG. 6C), control box 54 (FIG. 7) signals: primary-chamber valve 57 to open inlet port 57A and close exhaust port 57B; retraction-chambers valve 58 to open inlet port 58A and close exhaust port 50B; and projection-chambers valve 59 to close inlet port 59A and open exhaust port 59B. Control box 54 then starts blower 55 and air begins filling primary chamber 48, side retraction chambers 43B (FIG. 8A), and top retraction chamber 42B. Bladder 30 (FIG. 6B) straightens disheveled portions headward, footward, and laterally, bringing with it insulating layer 29 and sheet 33 which are fastened by zipper 35A and hook-and-loop fasteners 35B. If the bedward facing surfaces of the foot-end area of assembly 35 (FIGS. 6B and 7) are offset away from bed 38, they are pulled toward bed 38 by assembly 35's anchors (box-frame port 60 and hook-and-eye fasteners 53) until they abut the outer surfaces of bed 38.

As it begins to develop some rigidity from inflation, assembly 35 is pulled toward correct alignment with bed 38. This is because assembly 35 (FIG. 6B) is anchored to bed 38 by box-frame port 60 and hook-and-eye fasteners 53. It is also because the vertical wall of foot-end skirt 43A which faces bed 38 acts as a abutment or stop, preventing the portions of bladder 30 of which they are a part, from moving toward bed 38.

The shapes of the surfaces of bladder 30 (FIGS. 6B and 6C) which have direct or indirect contact with bed 38 are designed to act as guiding contours. They include the bedward surfaces of side skirts 43, and foot-end skirt 43A. For example, side skirts 43 are designed to offer additional aligning and positioning guidance. If assembly 35 is not aligned squarely with bed 38, then left or right side skirt 43 will be offset inward from the edge of bed 38. FIG. 10A shows a cross section of bladder 30 from FIG. 8B. It shows bladder 30 misaligned to the right of bed 38. Left side skirt 43 is also offset to the right and is riding up on the upper left edge of mattress 38A. Leveling pressure from assembly 35 being anchored by left and right hook-and-eye fasteners 53 (FIG. 6B), together with the force of gravity, creates a downward pressure on the lower surface of left side skirt 43 (FIG. 10A). This downward pressure causes offset left side skirt 43 to slide down its inclined surface, pulling, guiding, and rotating the bed covers toward their correct position and correct alignment with bed 38. Because the bedward surface of left side skirt 43 has convex shape 43C; the more it slides down that incline, the steeper is the contacting wall of left side skirt 43. Therefore, its relative sideward pulling force increases as correct alignment approaches. This helps compensate for the decreasing aligning pressure at the anchors (hook-and-eye fasteners 53 (FIG. 6B) and box-frame port 60) as proper alignment approaches. The correct alignment, or correct angular relationship of the bed covers with bed 38, thus has been predetermined: (a) by where bladder 30 and bed 38 are attached or anchored to each other; and (b) by the contours of assembly 35.

When side skirts 43 (FIG. 6C) have slid all the way down their bedward surfaces, the undersurface of assembly 35 abuts the upper surface of bed 38. The upper extremities of the bedward surface of side skirts 43 then become abutted against the left and right sides of bed 38.

The anchoring of the bed covers to bed 38 and the shape of side skirts 43 alter the path of movement and the angular displacement of the disheveled and disordered parts of the bed covers. Those parts thus move toward and terminate closer to where their proper positions and alignments are, when bladder 30 is deflated.

Tucking in the Bed Covers

FIGS. 68, 6C, 6D, 6E, 7, and 7A

FIGS. 6B, 6C, 7, and 7A: Primary air-pressure sensor 62A and retraction air-pressure sensor 62B signal control box 54 when primary chamber 48, top retraction chamber 42B, and side retraction chamber 43B reach full inflation. Tuck protrusions 45A are retracted against side skirts 43 by the attachment of side retraction chamber 43B to tuck chamber 45. Control box 54 then signals: primary-chamber valve 57 to close inlet port 57A; retraction-chambers valve 58 to close inlet port 58A and open exhaust port 58B; and projection-chambers valve 59 to close exhaust port 59B and open inlet port 59A. Side retraction chambers 43B and top retraction chambers 42B begin to deflate. Primary chamber 48 remains inflated while tuck chambers 45 and pillow-canopy chamber 42A begin to inflate.

FIGS. 6D, 6E, 7, and 7A: As tuck chambers 45 inflate, tuck protrusions 45A expand and become inserted into tuck openings 73. As pillow-canopy chamber 42A inflates, pillow canopy 42 unfolds and rotates over pillows 37. When tuck chambers 45 and pillow-canopy chamber 42A are fully inflated, projection air-pressure sensor 62C signals control box 54. Control box 54 then: stops blower 55; starts motor 63; signals primary-chamber valve 57 to open exhaust port 57B; and signals projection-chambers valve 59 to close inlet port 59A and open exhaust port 59B. Control box 54 signals motor 63 to lift tuck platforms 70 back up toward mattress 38A. The upper surface of tuck platforms 70 and lower surface of mattress 38A become closed against tuck protrusions 45A, frictionally gripping and restraining them in place. When left projection 75L depresses trip arm 77A, trip switch 77 sends a signal to control box 54 to shut off motor 63 and to reset drive shaft 63A for the opposite direction. The force of gravity on insulating layer 29 and on the upper surface of bladder 30 then deflates the chambers, expelling the pressurized air through exhaust port 57B, exhaust port 58B, and exhaust port 59B. Each chamber, therefore, has been selectively pressurized and depressurized in order to move the bed covers to their proper made positions.

Changing the Bed Covers

FIGS. 6D, 6F, 6G, and 7

The bed making cycle is now complete. The bed-cover layers of assembly 35 may be removed to be changed or washed. Hook-and-eye fasteners 53 are separated. Then bladder port 50 is removed from box-frame port 60. Latch 52D is depressed and grasping tab 52A is pulled out. Eyelet 52E is lifted off of top projection 52C. Then zippers 35A are unzipped and hook-and-loop fasteners 35B are pulled apart.

To reassemble, hook-and-loop fasteners 35B and zippers 35A are refastened. Eyelet 52E is placed over top projection 52C. Then grasping tab 52A is pulled down and pushed in a bedward direction until latch 52D engages. Reinforcing ring 52 contacts side stops 52B which restrict reinforcing ring 52 from moving further in a bedward direction.

Ventilation

FIGS. 6B, 9, and 9A

A conventional set of bed covers has porosities in the fabric of all its layers. These openings allow the migration of air and dispersion of moisture while a person is resting. Since bladder 30 has a non-porous membrane, this preferred embodiment has ventilating opening 78 and air channels 82A to allow air and moisture to pass through its bed covers. Convection, diffusion, and the breathing motion of the resting person propel the gaseous molecules of moisture and stale air along air channels 82A. They then exit out into the room through ventilating opening 78. Those same forces cause the gaseous molecules of fresh air to gradually migrate in the opposite direction. Air-porous fabric 78A allows the passage of air and moisture through itself while maintaining the continuity of the upper and lower surfaces of bladder 30.

Cloth ridges 82 of spacer layer 32 also act as spacers, increasing the distance between bladder 30 and the resting person's body. This increases the size of air reservoir 80 which dilutes the concentration of moisture and old air. Therefore comfort is enhanced.

DESCRIPTION

Embodiment with Lift Actuators

FIGS. 11, 12, and 13

Modifications in this embodiment lift assembly 35 up to release underlying covers and then position assembly 35 over pillows 37. This embodiment has no inflatable foot-end skirt 43A. In FIGS. 11 and 13 insulating layer 29, spacer layer 32, and sheet 33 are removed so the contours of an inflatable bladder 84 may be seen more clearly. A lift actuator 85 is at the lower foot end of side skirt 43. The upper part of lift actuator 85 is an expansion mechanism 85A which allows lift actuator 85 to expand upward and then contract downward. Expansion mechanism 85A has bellows undulations in its membrane to allow for efficient expansion and contraction. FIG. 12 shows that lift actuator 85 is narrower in its horizontal dimension than side skirt 43 which it supports. A hook-and-eye fastener 85B (FIG. 11) attaches the lower foot-end edge of lift actuator 85 to bed 38.

In this embodiment there is no separate pillow-canopy chamber 42A. The space within both pillow canopy 42 and lift actuators 85 are a part of primary chamber 48. Pressurized air passes in and out of primary chamber 48 (FIG. 12) through a primary-chamber port 86A in right lift actuator 85. A tuck-chambra port 86B is built into left lift actuator 85. A tuck-chambera conduit 87 allows pressurized air to pass to and from tuck chambers 45 (FIG. 11).

OPERATION

Embodiment with Lift Actuators

FIGS. 11, 12, and 13

As air pressure increases during inflation of primary chamber 48 (FIG. 13), expansion mechanism 85A expands to its limit, which moves the headward portion of bladder 84 away from bed 38. This action removes the weight from any covers which may be crumpled, folded, and disheveled underneath, facilitating the freeing up and straightening of the bed covers. It also allows pillow canopy 42 to inflate without interference from pillows 37. After primary chamber 48 fully inflates, the exhausting of pressurized air from it is begun. As the air pressure in primary chamber 48 decreases, expansion mechanism 85A is the first to collapse upon itself. This is because expansion mechanism 85A (FIG. 12) is smaller in its horizontal cross-sectional area than side skirt 43 above it. Bladder 84 (FIG. 11) then moves back to bed 38, being guided into position by side skirts 43. When the drop in air pressure is sufficient to collapse expansion mechanism 85A, the exhausting of air from primary chamber 48 is stopped so bladder 84 may retain its rigidity. At this point the tuck sequence is carried to completion as described for the preferred embodiment above. After the tuck sequence is completed, all remaining inflated chambers of bladder 84 are allowed to deflate.

The attaching of primary-chamber port 86A (FIG. 12) and tuck-chambers port 86B to bed 38 provides an additional aligning influence when bladder 84 is inflated and deflated.

DESCRIPTION

Embodiment with Valved Chamber Walls

FIGS. 14 to 14E

In this embodiment: (a) the insulating layer is integral with the top surface of the bladder; (b) the outer surface of the bladder has a decorative application; and (c) inflation and deflation of chambers are additionally modulated by valves in chamber walls.

FIG. 14 is an overhead view showing this embodiment under inflation and showing the section lines for FIGS. 14A. The sectional views of FIGS. 14C, 14D, and 14E are taken along the same sectional plane as FIG. 14A. FIG. 14B is a right side view showing an inflatable bladder 91. Bladder 91 is shown without insulating layer 29, spacer layer 32, or sheet 33 so its shape may be seen more clearly. Bladder 91 is anchored to the lower foot-end edge of bed 38 by a zipper fastener 91A. The left and right foot ends of side skirt 43 have a bellows-like expansion section 91B to aid in tilting bladder 91 upward during inflation.

FIG. 14A shows that a series of three chambers 92A, 92B, and 92C, divided by a chamber wall 93 and a chamber wall 94, extend from the foot end of bladder 91 to its head end. Chamber walls 93 and 94 have a one-way air-pressure-sensitive intake valve 93A and 94A respectively and a large one-way exhaust valve 93B and 948 respectively. Intake valves 93A and 94A are designed so they do not open until the air within chambers 92A and 92B respectively has elevated to slightly below maximum inflation pressure. When intake valves 93A and 94A open, the airway through each of them is small enough to cause only a small drop in air pressure in chambers 92A and 92B respectively. As air is forced through them, intake valves 93A and 94A allow a successive inflation of each chamber 92A, 92B, and 92C. Thus, intake valves 93A and 94A act as regulating valves, controlling the timing for the passage of air into chambers 92B and 92C. Exhaust valves 93B and 94B are regulating valves designed to open when the air pressures in chambers 92A and 92B respectively become less than the air pressures in chambers 92B and 92C respectively.

OPERATION

Embodiment with Valved Chamber Walls

FIGS. 14 to 14E

FIG. 14C shows the first stage of inflation for the embodiment. When blower 55 starts, chamber 92A begins to inflate. Before maximum air pressure is reached, intake valve 93A opens and chamber 92B (FIG. 14D) inflates and lifts up to become suspended over mattress 38A. When chamber 92B has become inflated, valve 94A opens and chamber 92C (FIG. 14E) inflates. When maximum air pressure and complete inflation are achieved, blower 55 shuts off. Air exits through exhaust valves 94B and 93B and out of chamber 92A until bladder 91 settles onto bed 38 (FIG. 14A). It is guided into position by side skirts 43 (FIG. 14B). After the tuck sequence is completed, all remaining inflated chambers are allowed to deflate.

DESCRIPTION

Embodiment with Retraction Drawstrings FIGS. 15 to 16A

The sectional views of FIGS. 15 and 16 are taken along the same sectional plane as FIG. 14A. The sectional views of FIGS. 15A and 16A are taken along the same sectional plane as FIG. 6E. FIGS. 15 and 15A show an inflatable bladder 95 which houses a drawstring chamber 96. A drawstring-chamber conduit 97 (FIG. 15) carries pressurized air to and from drawstring chamber 96. A drawstring 96A zigzags through a series of eyelets 96B within drawstring chamber 96. Eyelets 96B are attached to the upper and lower membrane surfaces of drawstring chamber 96. In FIGS. 16 and 16A drawstring chamber 96 is deflated. Drawstring 96A (FIG. 16) passes through the head-end chamber wall of drawstring chamber 96 and is attached to the head end of pillow canopy 42. FIG. 15A shows that there are a series of drawstrings 96A positioned from the left side of drawstring chamber 96 to the right. Drawstring chamber 96 is attached to tuck chamber 45 at the lower edge of side skirt 43.

OPERATION

Embodiment with Retraction Drawstrings FIGS. 15 to 16A

Blower 55 (FIG. 15) is started and both primary chamber 48 and drawstring chamber 96 are filled with pressurized air. Because the upper and lower chamber walls of drawstring chamber 96 move away from each other when it inflates, drawstring 96A is pulled into drawstring chamber 96 from pillow canopy 42. This action retracts pillow canopy 42 back against the headward end of drawstring chamber 96. At the same time, tuck protrusions 45A (FIG. 15A) are being pulled back against the bedward sides of side skirts 43 by the outer lateral membrane walls of drawstring chamber 96. Drawstring chamber 96 (FIGS. 16 and 16A) is then deflated. As it deflates, pressurized air is forced into tuck chambers 45 and pillow-canopy chamber 42A. Pillow canopy 42 expands and rotates over pillows 37. After the tuck sequence is completed, all remaining inflated chambers are allowed to deflate.

DESCRIPTION

Embodiment with Internal Sliding Chambers FIGS. 17 And 17A

The sectional views of FIGS. 17 and 17A are taken along the same sectional plane as FIG. 14A. This embodiment has an inflatable bladder 98 (FIGS. 17 and 17A) which uses a footward projection chamber 98A, a retraction chamber 98B, and a headward projection chamber 98C, to pull pillow canopy 42 footward and then push it headward over pillows 37. A foot-end chamber 98D is at the foot-end area of bladder 98, and a head-end chamber 98E is at the head-end area of bladder 98. A chamber wall 99 separates chamber 98B from chamber 98C. Chamber wall 99 extends up above chambers 98B and 98C, to be attached to the lower side of the upper membrane of bladder 98. Chamber wall 99 extends down below chambers 98B and 98C, to be attached to the upper side of the lower membrane of bladder 98. A series of fabric strips 99A run from their attachment at the upper head-end edge of chamber 98A to their attachment at the upper foot end of chamber 98E. A second series of fabric strips 99A run from their attachment at the lower head-end edge of chamber 98A to their attachment at the lower foot end of chamber 98E. Each fabric strip 99A passes through one of an upper and lower series of openings 99B in chamber wall 99 as it runs from chamber 98A to chamber 98E. Bladder 98 is attached to the upper foot-end edge of box frame 38B by a zipper fastener 100.

OPERATION

Embodiment with Internal Sliding Chambers FIGS. 17 and 17A

When blower 55 is started, chambers 98B, 98D, and 98E are inflated first. As chamber 98B inflates it pulls fabric strips 99A footward. Pillow canopy 42 becomes positioned footward of pillows 37. This action prevents pillow canopy 42 from impinging on pillows 37 as it inflates and is subsequently moved headward.

Chamber 98B is allowed to deflate while chambers 98A and 98C are inflated. The inflation of chambers 98A and 98C pushes pillow canopy 42 headward over pillows 37. After the tuck sequence is completed, all remaining inflated chambers are allowed to deflate.

DESCRIPTION

Embodiment with Foot-End Retraction Chamber FIGS. 18 to 18B

The sectional views of FIGS. 18 and 18A are taken along the same sectional plane as FIG. 14A. In this embodiment an inflatable bladder 101 (FIG. 18) has a collapsible retraction chamber 102 designed into the headward side of foot-end skirt 43A to rotate foot-end skirt 43A away from bed 38. A collapsible projection chamber 103 (FIGS. 18A and 18B) runs from the left side to the right side of bladder 101 between a foot-end chamber 104 and a head-end chamber 105.

OPERATION

Embodiment with Foot-End Retraction Chamber FIGS. 18 to 18B

When blower 55 (FIG. 18) is started, chambers 102, 104, and 105 are inflated first. This action positions pillow canopy 42 to the footward of pillows 37. Chamber 102 is then allowed to deflate while chamber 103 (Figs 18A and 18B) is inflated. The expansion of chamber 103 pushes pillow canopy 42 headward over pillows 37. After the tuck sequence is completed, all remaining inflated chambers are allowed to deflate.

CONCLUSION, RAMIFICATIONS, AND SCOPE

Accordingly the reader will see the automatic bed maker of the invention provides a simple to operate, low profile, and safe device that can be used in a wide variety of situations to easily make a bed. This automatic bed maker can be used to repeatedly make a bed with just a push of a button:

- It provides an automatic bed maker which includes an inflatable bladder configuration to straighten and position the bed covers.
- It provides releasable fasteners so the layers of the bed covers may be changed and cleaned.
- It provides ventilation of the bed covers to disperse moisture and circulate fresh air.

It provides automatic tucking-in of the covers along the sides of the bed.

It provides automatic moving away of the bed covers from the bed to allow their correct placement over the pillows.

It provides an automatic bed maker which can be built into the bed without altering the bed's external profile.

It provides an automatic bed maker which permits the operator to leave the room or do other work while the invention is making the bed.

It provides an automatic bed maker which fits in with the atmosphere of the bedroom setting because it does not have bulky external parts.

While the above description contains many specificities, these should not be construed as limitations on the scope of the invention, but as exemplifications of the presently-preferred embodiments thereof. Many other ramifications and variations are possible within the teachings to the invention. For example:

Assembly Layers:

The layers may be varied as to the number of layers, their types, and their position in the bed-cover assembly. The insulating layer may be a blanket, bed spread, comforter, or quilt. A bedspread may be fastened above or substituted for the insulating layer. A comforter or quilt may be added to the assembly. The bladder layer may be on top, with its upper surface having a decorative application. The bladder layer may be permanently fastened to or integral with the upper or lower side of another layer such as a blanket, so they become one layer.

The insulating layer(s) may be removed and a spacer layer with enlarged air channels may be included to provide coolness and comfort in the summer.

Assembly Fasteners:

The layers may be fastened together by hook-and-eye fasteners, snaps, ties, clips, adhesives, suction cups, buckles, pins, magnets, and buttons in addition to, or instead of the zippers and hook-and-loop fasteners used in the description.

Number of Bladders:

The bladder configuration may use a number of bladders rather than one large bladder to straighten out and position the bed covers. There may be a bladder along each side of the bed. There may then be a bladder at the head end and at the foot end of the bed to connect the two side bladders.

Bladder Valves:

Diaphragm and pressure sensitive valves may be used to modify the movement of air between chambers, between bladders, and between bladders and the outside air.

Bladder Contours and Shape:

The bladder configuration may be designed to have its side and headward edges to curl up, creating a bowl-like shape. This would provide extra lift to help unravel a bed-cover assembly which uses heavy layers of covers.

Each bladder may be designed without stringers. The result would be a very economical version which balloons out when inflated.

The bladder may be designed without an inflating foot-end skirt in order to accommodate a footboard.

Stringers:

Cords, strips of cloth, elastics, flexible sheet material, line and filament material, and box stitching may be used, in addition or instead of threads, in the construction of stringers.

Ventilating holes:

More than one ventilating hole may be designed into the bladder configuration. The ventilating hole(s) may be various shapes, such as round, oval, and triangular and irregular.

Inflation:

The bladder configuration may be inflated with a fluid other than air. The bladder configuration may be inflated by a pump, an inflation fluid storage device, or a chemical reaction that produces an expansion of fluid.

Deflation passageways:

Structures may be added to the inside of the bladder configuration to facilitate the movement of inflation fluid out of the bladder configuration and prevent the formation of pockets of fluid. Corrugations or material with a pile construction may line the inner surface of the bladder membranes to provide escapeways for trapped fluid.

Location of Ports and Anchors:

There may be multiple ports for transferring inflation fluid from the inflation mechanism to the bladder, bladders, and/or chambers. These ports may be separated, side-by-side, or one port within another. There may be a single or multiple anchoring points for anchoring a bed cover or bed covering layer to the bed or other fixed structure.

Method of anchoring:

The anchor points of the assembly with the bed may be isolated away from the ports rather than integrated with the port's attachment to the bed. The method of attachment may be magnets, snaps, hooks, pinch clips, suction cups, buckles, pins, hook-and-eye or hook-and-loop fasteners, screw-on hardware, zippers, buttons, and ties.

Without Anchoring:

There may be no anchoring of assembly to the bed. An inflated left, right, and/or foot end skirt may then assist an operator in guiding the bed covers to their correct position and alignment on the bed.

Box Frame:

A box spring, a platform, a mat support, or a bed frame may be used instead of a box frame as the base for mounting the automatic bed-maker parts and attaching the assembly.

Tuck platform:

The upper surface of the box frame may extend above the tuck opening to the edge of the bed The tuck protrusion then would be sandwiched between that upper surface and the tuck platform when the tuck platform rises.

The cloth shield may be replaced by a shingled arrangement of interlocking sliding panels.

Instead of having headward and footward outer corners flanking the tuck opening, the tuck opening may extend headward and footward an additional 20 cm. A semi-flexible sheet material may connect the upper headward and footward edges of the tuck platform with the upper headward and footward edges of the tuck opening, and the outer side edges of the tuck platform with the outer side edges of the tuck opening. The box frame, the semi-flexible sheet material, and the tuck platform would then create a contiguous surface which would deform downward and inward as the tuck opening opened, to allow the entrance of the tuck protrusion.

The up and down movement of the tuck platform may be guided by a set of vertical tracks, rather than having it hinged to the upper inner edge of the tuck opening.

Power source and transmission:

The tuck platform may be raised and lowered by the use of hydraulic pistons, air bellows, cables and pulleys, cogged tracks, straps and reels, vertical screws, and geared levers. These mechanical configurations may be powered by an hydraulic pump, an air pump, an air blower, or an electric motor.

Expansion, projection, and extension mechanisms:

A cylinder and piston or an expanding diaphragm may be used, instead of a membrane segment with bellows undulations, to provide the action of moving the assembly away from the bed.

Reducing bladder size:

The dimensions of the inflated bladder may be reduced by using a stronger bladder membrane and high inflation pressure. Stays may be added to provide additional support within the lift actuator or within other areas of the bladder.

Heat distribution:

A heating element may be installed in the box frame. A network of air channels may extend from the heating element to a variety of points on the underside of the bladder layer. Then heated air may be forced through this system to warm the bed prior to use.

Bed freshening:

The network of air channels mentioned directly above may also be used to disperse bed freshening vapors within or below the assembly.

Accordingly, the scope of the invention should be determined by the appended claims and their legal equivalents, rather than by the examples given.

I claim:

1. A bed making apparatus comprising:

a bed including an occupant support structure;

a bed covering;

an inflatable bladder including a first inner, gas-tight chamber and a first fastener for coupling the bladder to the bed covering so that the bladder and the bed covering may not move relative to one another, wherein the inflatable bladder is coupled to the bed and is shaped so that, when inflated, the bed covering is arranged over the bed in a predetermined position, the inflatable bladder including a top portion which, when received on the occupant support structure in a desired position, lays flat across a substantially horizontal portion of the occupant support structure and a side portion which extends beyond an outer edge of at least one side of the horizontal portion, wherein the side portion of the inflatable bladder is coupled to a portion of the bed located below the substantially horizontal portion so that, when inflated, the top portion of the inflatable bladder extends ac ross the substantially horizontal portion with the side portion thereof wrapping around the at least one side of the horizontal portion drawing a corresponding side portion of the bed covering around the at least one side of the horizontal portion;

a strap extending under the occupant support structure between a first side of the inflatable bladder and a second side thereof;

a second fastener for coupling one of the bladder and the bed covering to the bed so that a portion of the bladder and a corresponding portion of the bed covering may not move relative to the bed;

a source of pressurized gas coupled to the inflatable bladder;

a sensor for sensing a pressure within the bladder; and a controller for selectively operating the source of pressurized gas to supply gas to the bladder until the pressure within the bladder reaches a predetermined pressure, wherein, after the pressure within the bladder has reached the predetermined pressure, the controller stops the supply of pressurized gas and allows the air in the bladder to escape so that the bed covering settles onto the bed in substantially the predetermined position.

2. The apparatus according to claim 1 wherein the horizontal portion includes four sides, and wherein the side portion of the inflatable bladder extends beyond outer edges of three of the sides of the substantially horizontal portion and wherein the side portion of the inflatable bladder is coupled to the three covered sides of the bed at locations below the substantially horizontal portion so that, when inflated, the top portion of the inflatable bladder extends across the substantially horizontal portion with the side portion wrapping around each of the three sides of the bed and drawing corresponding side portions of the bed covering around the three sides of the bed.

3. The apparatus according to claim 1, wherein the inflatable bladder includes first and second gas-tight chambers wherein, when the first gas-tight chamber is inflated, a first portion of the bed covering is drawn into a first position on the bed and wherein, when the second gas-tight chamber is inflated, a second portion of the bed covering is drawn into a position different than that to which the second portion of the bed covering is drawn by inflation of the first gas-tight chamber, the occupant support structure being supported on a base, an outer portion of which is movable with respect to the occupant support structure and wherein, when the outer portion of the base is moved away from the occupant support structure and the second gas-tight chamber is inflated, the second portion of the inflatable bladder and the second portion of the bed covering are positioned between the outer portion of the base and the occupant support structure so that, when the outer portion of the base is moved toward the occupant support structure, the second portion of the inflatable bladder and the second portion of the bed covering are gripped between the outer portion of the base and the occupant support structure.

4. The apparatus according to claim 3, further comprising a motor and a linkage coupled between the motor and the outer portion of the base, wherein, when the motor is driven in a first direction, the linkage moves so that the outer portion of the base is moved away from the occupant support structure and, when the motor is driven in a second direction, the linkage moves so that the outer portion of the base is moved toward the occupant support, and wherein the apparatus further comprises a controller for synchronizing the operation of the electric motor, the source of pressurized gas and the valve.

5. The apparatus according to claim 4, further comprising means coupled to the controller for determining the pressure in each of the first, second and third gas-tight compartments, wherein the controller operates the valve so that first, second and third gas-tight compartments are inflated and deflated in a predetermined sequence.

6. A bed making apparatus comprising:

a bed including an occupant support structure supported on a base, wherein an outer portion of the base is moveable with respect to the occupant support structure;

a motor and a linkage coupled between the motor and the outer portion of the base, wherein, when the motor is driven in a first direction, the linkage moves so that the outer portion of the base is moved away from the occupant support structure and, when the motor is driven in a second direction, the linkage moves so that the outer portion of the base is moved toward the occupant support; and an inflatable bladder including means for coupling to a bed covering so that the bed covering and the inflatable bladder are maintained in a predetermined position relative to one another, wherein the inflatable bladder includes first and second inner, gas-tight chambers, wherein, when the first gas-tight chamber is inflated, a corresponding first portion of the inflatable bladder is drawn into a position different than the position to which the first portion of the inflatable bladder is drawn by inflation of only the second gas-tight chamber and, when the second gas-tight chamber is inflated, a corresponding second portion of the inflatable bladder is drawn into a position different than the position to which the second portion of the inflatable bladder is drawn by inflation of only the first gas-tight chamber; and a controller for synchronizing the operation of the electric motor and the inflation of the first and second gas-tight chambers of the inflatable bladder.

7. The apparatus according to claim 6, wherein the inflatable bladder includes a third gas-tight chamber which, when inflated, draws a corresponding third portion of the inflatable bladder into a position different than that to which the third portion of the inflatable bladder is drawn by inflation of any of the first and second gas-tight chambers, wherein the apparatus further comprises means coupled to the controller for determining the pressure in each of the first, second and third gas-tight compartments, wherein the controller operates the valve so that first, second and third gas-tight compartments are inflated and deflated in a predetermined sequence.

* * * * *